US009237985B2

(12) United States Patent
Eckhoff et al.

(10) Patent No.: US 9,237,985 B2
(45) Date of Patent: Jan. 19, 2016

(54) MULTI-COMPARTMENT PHARMACEUTICAL VIALS

(71) Applicant: Tokitae LLC, Bellevue, WA (US)

(72) Inventors: Philip A. Eckhoff, Kirkland, WA (US); Muriel Y. Ishikawa, Livermore, CA (US); Orin Levine, Mercer Island, WA (US); Nels R. Peterson, Bellevue, WA (US); Lowell L. Wood, Jr., Bellevue, WA (US); Victoria Y. H. Wood, Livermore, CA (US)

(73) Assignee: TOKITAE LLC, Bellevue, WA (US)

( * ) Notice: Subject to any disclaimer, the term of this patent is extended or adjusted under 35 U.S.C. 154(b) by 87 days.

(21) Appl. No.: 13/945,499

(22) Filed: Jul. 18, 2013

(65) Prior Publication Data

US 2015/0021288 A1 Jan. 22, 2015

(51) Int. Cl.

| | |
|---|---|
| ***A61J 1/06*** | (2006.01) |
| ***A61J 1/14*** | (2006.01) |
| ***A61J 1/20*** | (2006.01) |

(52) U.S. Cl.

CPC ..... *A61J 1/065* (2013.01); *A61J 1/1406* (2013.01); *A61J 1/1412* (2013.01); *A61J 1/2096* (2013.01); *A61J 1/1418* (2015.05); *A61J 1/1425* (2015.05)

(58) Field of Classification Search

CPC ..... B65D 51/002; B65D 2101/0084; B65D 41/32; B65D 1/04; A61J 1/1406; A61J 1/18; A61J 1/065; A61J 1/1412; A61J 1/2096

USPC ..... 215/6, 247, DIG. 3; 604/410, 415; 220/254.1, 500

See application file for complete search history.

(56) References Cited

U.S. PATENT DOCUMENTS 2,459,304 A * 1/1949 Blank ..... 215/247
4,089,432 A 5/1978 Crankshaw et al.

(Continued)

FOREIGN PATENT DOCUMENTS

WO WO 99/25629 5/1999

OTHER PUBLICATIONS

Akinsanya-Beysolow et al.; "Advisory Committee on Immunization Practices (ACIP) Recommended Immunization Schedule for Persons Aged 0 through 18 Years—United States, 2013"; MMWR; Jan. 28, 2013; pp. 2-8; vol. 62.

(Continued)

*Primary Examiner* — Robert J Hicks
*Assistant Examiner* — Shawn M Braden
(74) *Attorney, Agent, or Firm* — Dorsey & Whitney LLP

(57) ABSTRACT

Multi-compartment pharmaceutical vials are described. In some embodiments, a multi-compartment pharmaceutical vial includes: a multi-compartment pharmaceutical storage region including a bottom wall, at least one outer wall and at least one interior wall, the bottom wall, the at least one outer wall and the at least one interior wall forming a plurality of pharmaceutical storage compartments, each pharmaceutical storage compartment including an aperture positioned opposite to the bottom wall of the pharmaceutical storage region; and an access region attached to the pharmaceutical storage region, the access region including a plurality of conduits, each with a first end and a second end, wherein the first end of each conduit is connected to one aperture in a pharmaceutical storage compartment, and the second end of each conduit circumscribes an aperture positioned opposite to the bottom wall.

41 Claims, 10 Drawing Sheets

(56) References Cited

U.S. PATENT DOCUMENTS

| | | | | |
|---|---|---|---|---|
| 4,527,703 | A | 7/1985 | Cummings | |
| 5,009,309 | A | 4/1991 | Hansen | |
| 5,232,108 | A | 8/1993 | Nakamura | |
| 5,242,066 | A | 9/1993 | Kelsey | |
| 5,910,138 | A | 6/1999 | Sperko et al. | |
| 6,604,561 | B2 | 8/2003 | Py | |
| 6,684,916 | B2 | 2/2004 | Py | |
| 6,733,273 | B1 | 5/2004 | Hansen | |
| 6,846,305 | B2 | 1/2005 | Smith et al. | |
| 7,258,251 | B2 * | 8/2007 | Johnson | 222/129 |
| 7,282,269 | B2 | 10/2007 | Wang et al. | |
| 7,707,807 | B2 | 5/2010 | Py | |
| 8,556,183 | B2 | 10/2013 | Bray | |
| 2005/0234422 | A1 * | 10/2005 | Oh et al. | 604/415 |
| 2005/0258129 | A1 | 11/2005 | Model | |
| 2009/0016936 | A2 | 1/2009 | Balestracci et al. | |
| 2010/0094244 | A1 * | 4/2010 | Pech | 604/415 |
| 2012/0089088 | A1 * | 4/2012 | Foshee et al. | 604/85 |
| 2012/0104660 | A1 | 5/2012 | Disawal et al. | |

OTHER PUBLICATIONS

Lee et al.; "Single versus Multi-Dose Vaccine Vials: An Economic Computational Model"; Vaccine; Jul. 19, 2010; pp. 5292-5300; vol. 28, No. 32; Elsevier Ltd.

Thryft, Ann R.; "Self-Healing Plastic Changes Color When Damaged"; Design News; Apr. 30, 2012; pp. 1-2; UBM Canon; located at http: //www.designnews.com/author.asp?section_id-1392&doc_id=242838&print=yes.

World Health Organization; "Guidelines on the international packaging and shipping of vaccines"; Dec. 2005; pp. i-viii, 1-30, and two cover pages; Ordering code WHO/IVB/05.23; WHO Document Production Services; Geneva, Switzerland.

U.S. Appl. No. 14/306,443, Boomgard et al.

Astin, Angela Didomenico; "Finger force capability: measurement and prediction using anthropometric and myoelectric measures"; Virginia Polytechnic Institute and State University M.S. thesis; submitted Dec. 16, 1999; pp. i-x, 1-93; located at http://scholar.lib.vt.edu/theses/available/etd-01132000-12570058/unrestricted/thesis_astin.pdf.

World Health Organization; Getting started with vaccine vial monitors; Vaccines and Biologicals, World Health Organization; Dec. 2002; pp. 1-20 plus cover sheets, end sheet, contents pages, abbreviations page; revision history page and acknowledgments page (29 pages total); World Health Organization; located at.www.who.int/vaccines-documents.

World Health Organization; Getting started with vaccine vial monitors—Questions and answers on field operations; Technical Session on Vaccine Vial Monitors, Mar. 27, 2002, Geneva; pp. 1-17 (p. 2 left intentionally blank); World Health Organization.

* cited by examiner

MULTI-COMPARTMENT PHARMACEUTICAL VIALS

If an Application Data Sheet (ADS) has been filed on the filing date of this application, it is incorporated by reference herein. Any applications claimed on the ADS for priority under 35 U.S.C. §§119, 120, 121, or 365(c), and any and all parent, grandparent, great-grandparent, etc. applications of such applications, are also incorporated by reference, including any priority claims made in those applications and any material incorporated by reference, to the extent such subject matter is not inconsistent herewith.

CROSS-REFERENCE TO RELATED APPLICATIONS

The present application claims the benefit of the earliest available effective filing date(s) from the following listed application(s) (the "Priority Applications"), if any, listed below (e.g., claims earliest available priority dates for other than provisional patent applications or claims benefits under 35 USC §119(e) for provisional patent applications, for any and all parent, grandparent, great-grandparent, etc. applications of the Priority Application(s)). In addition, the present application is related to the "Related Applications," if any, listed below.

PRIORITY APPLICATIONS

None.

RELATED APPLICATIONS

None.

If the listings of applications provided above are inconsistent with the listings provided via an ADS, it is the intent of the Applicant to claim priority to each application that appears in the Priority Applications section of the ADS and to each application that appears in the Priority Applications section of this application.

All subject matter of the Priority Applications and the Related Applications and of any and all parent, grandparent, great-grandparent, etc. applications of the Priority Applications and the Related Applications, including any priority claims, is incorporated herein by reference to the extent such subject matter is not inconsistent herewith.

SUMMARY

In some embodiments, a multi-compartment pharmaceutical vial includes: a multi-compartment pharmaceutical storage region including a bottom wall, at least one outer wall and at least one interior wall, the bottom wall, the at least one outer wall and the at least one interior wall forming a plurality of pharmaceutical storage compartments, each pharmaceutical storage compartment including an aperture positioned opposite to the bottom wall of the pharmaceutical storage region; and an access region attached to the pharmaceutical storage region, the access region including a plurality of conduits, each with a first end and a second end, wherein the first end of each conduit is connected to one aperture in a pharmaceutical storage compartment, and the second end of each conduit circumscribes an aperture positioned opposite to the bottom wall.

In some embodiments, a multi-compartment pharmaceutical vial includes: a multi-compartment pharmaceutical storage region, including a bottom wall, at least one outer wall, and at least one interior wall, the walls forming at least two pharmaceutical storage compartments, each of the at least two pharmaceutical storage compartments including an aperture at a position distal to the bottom wall; an access region attached to the pharmaceutical storage region, the access region including a plurality of conduits with a first end and a second end, wherein the first end of each conduit is connected to one aperture in a pharmaceutical storage compartment, and wherein the second end of each conduit forms an aperture positioned opposite to the bottom wall, the access region including an outer surface; at least one conduit seal, each of the at least one conduit seal reversibly mated with at least one second end of one of the plurality of conduits; a cover with a surface reversibly mated with outer surface of the access region and a surface of the at least one conduit seal.

In some embodiments, a multi-compartment pharmaceutical vial includes: a multi-compartment pharmaceutical storage region, including a bottom wall, at least one outer wall, and at least one interior wall, the walls forming an even number of pharmaceutical storage compartments, each of the pharmaceutical storage compartments including a single aperture at a position distal to the bottom wall, and each of the pharmaceutical storage compartments positioned adjacent to the at least one outer wall; an access region including an outer surface, the access region attached to the pharmaceutical storage region, the access region including a plurality of conduits with a first end and a second end, wherein the first end of each conduit is connected to the single aperture in a pharmaceutical storage compartment, and wherein the second end of each conduit forms an aperture positioned opposite to the bottom wall; at least one conduit seal, each of the at least one conduit seal reversibly mated with at least one second end of one of the plurality of conduits; a cover with a surface reversibly mated with outer surface of the access region and a surface of the at least one conduit seal.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
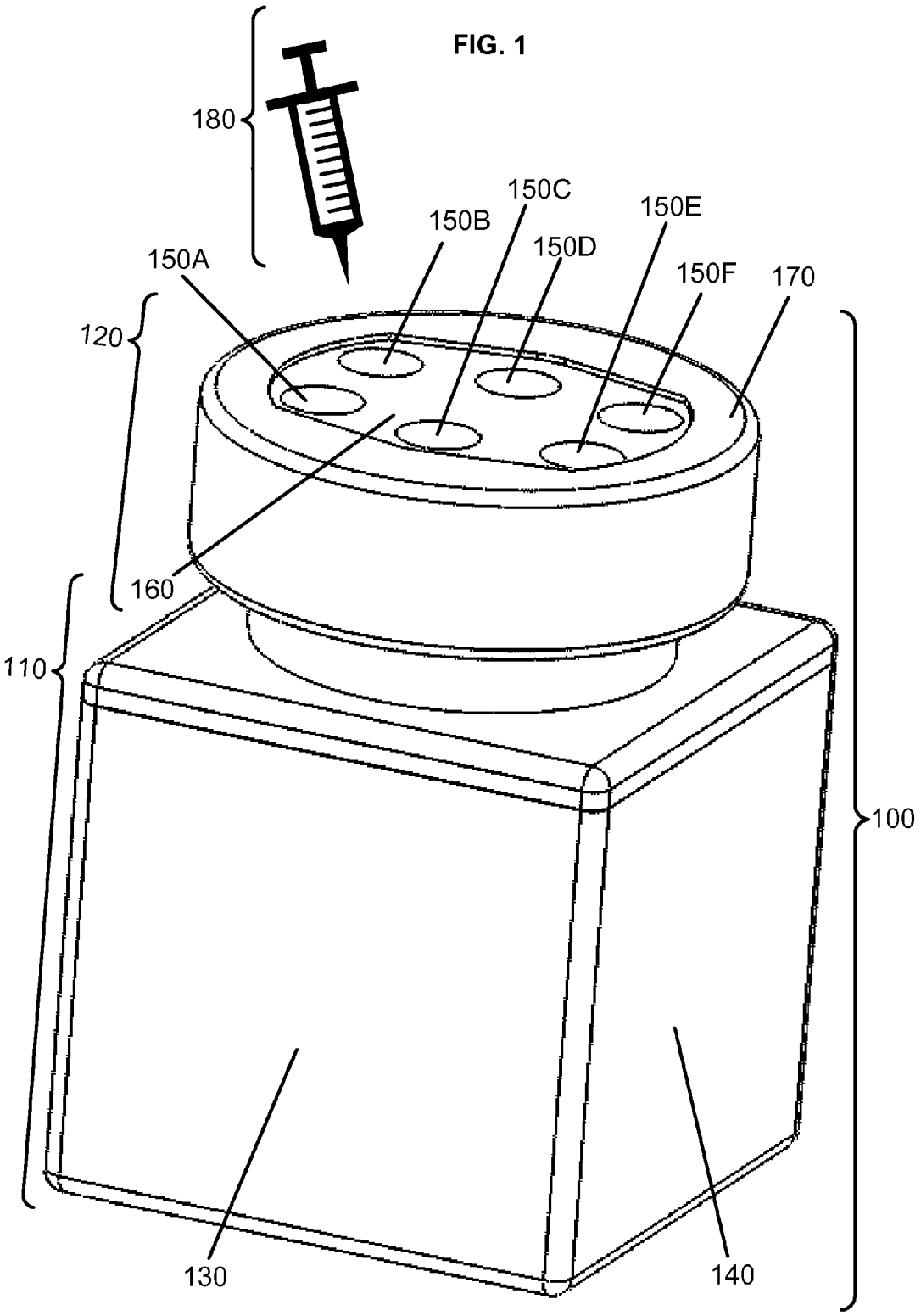
FIG. 1 is a schematic of an embodiment of a multi-compartment pharmaceutical vial.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. The use of the same symbols in different drawings typically indicates similar or identical items unless context dictates otherwise.

FIG. 1 illustrates an embodiment of a multi-compartment pharmaceutical vial 100. The multi-compartment pharmaceutical vial 100 illustrated in FIG. 1 includes a multi-compartment pharmaceutical storage region 110 and an access region 120. In some embodiments, the multi-compartment pharmaceutical storage region 110 includes a bottom wall and four outer walls oriented to form a substantially rectangular structure. FIG. 1 shows a first outer wall 130 and a second outer wall 140. In the embodiment illustrated, the first outer wall 130 and the second outer wall 140 have faces of substantially similar dimensions, and the multi-compartment pharmaceutical storage region 110 is approximately cubical. In some embodiments, a multi-compartment pharmaceutical vial includes a multi-compartment pharmaceutical storage region configured as a rectangular shape. In some embodiments, a multi-compartment pharmaceutical vial includes a multi-compartment pharmaceutical storage region configured as a cylindrical shape. In some embodiments, a multi-compartment pharmaceutical vial includes a multi-compartment pharmaceutical storage region configured as a polyhedron. In some embodiments, at least one outer wall of the multi-compartment pharmaceutical storage region includes an external face of a suitable size and shape for a pharmaceutical label.

The multi-compartment pharmaceutical vial 100 illustrated in FIG. 1 includes an access region 120. The access region 120 is attached to the top of the multi-compartment pharmaceutical storage region 110 in an orientation for use and storage of the multi-compartment pharmaceutical vial 100. In some embodiments, the multi-compartment pharmaceutical storage region 110 and the access region 120 are integrated. In some embodiments, the multi-compartment pharmaceutical storage region 110 and the access region 120 are fabricated from the same material. In the embodiment illustrated, the access region 120 includes a plurality of conduits within the interior structure of the access region 120, the conduits arrayed substantially in parallel and substantially perpendicular to the exterior face of a cover 160 positioned over the top surface of the access region 120. Each of the conduits has an aperture at the top surface of the access region 120. In some embodiments, each of the plurality of conduits are within a single internal structure of the access region that surrounds the plurality of the conduits with a single edge region. In some embodiments, each of the plurality of conduits are not separately visible from a view external to the access region. In some embodiments, one or more of the plurality of conduits includes an exterior wall that is coextensive with an exterior edge of the access region.

A conduit seal is positioned adjacent to the aperture of each conduit, and the cover 160 is positioned over the conduit seal. Each conduit seal is fabricated and positioned to allow a syringe 180 to pierce the conduit seal and gain access to a single compartment within the compartment pharmaceutical storage region 110 attached to that interior conduit. The cover 160 includes a plurality of cover apertures 150 corresponding to the aperture of each conduit. The plurality of cover apertures 150 A, 150 B, 150 C, 150 D, 150 E, and 150 F are collectively referred to as "cover apertures 150" with reference to the figures herein. In the embodiment illustrated in FIG. 1, the access region 120 includes six conduits within the interior structure, corresponding to the six cover apertures 150 shown. Each cover aperture 150 is positioned to allow a syringe 180 to pierce the conduit seal adjacent to the cover aperture. A fastener 170 is secured around the access region 120 and positioned to secure the cover 160 in place relative to the access region 120.

In some embodiments, a cover is fabricated from a metallic material, such as aluminum or an alloy. In some embodiments, a cover is fabricated from a plastic material, such as polypropylene. In some embodiments, a fastener is fabricated from a metallic material. In some embodiments, a fastener is fabricated from a plastic material. In some embodiments, covers and/or fasteners are fabricated from bio-compatible materials. In some embodiments, covers are fabricated from materials that can be re-sealed after puncture, such as during an aseptic fill of the multi-compartment pharmaceutical vial. See U.S. Pat. Nos. 6,604,561 and 6,684,916, each titled "Medicament Vial Having a Heat-Sealable Cap, and Apparatus and Method for Filling the Vial" to Py, incorporated by reference herein.

Multi-compartment pharmaceutical vials as described herein are configured for storage of pharmaceuticals prior to administration to an individual, such as during shipment and prior to need of the pharmaceutical. Although the text herein is generally stated in the context of human medical situations, a multi-compartment pharmaceutical vial can be utilized in non-human (i.e. veterinary) situations. Each of the individual compartments within a multi-compartment pharmaceutical vial is configured to store an isolated, single dose of a pharmaceutical for administration at a single time. For example, in some embodiments a multi-compartment pharmaceutical vial including six compartments can store six doses of a vaccine, each dose located in an individual compartment of the multi-compartment pharmaceutical vial. For example, in some embodiments a multi-compartment pharmaceutical vial including four compartments can store four doses of a vaccine, each dose located in an individual compartment of the multi-compartment pharmaceutical vial. Each compartment of a multi-compartment pharmaceutical vial is configured to store a single dose of a pharmaceutical. A multi-compartment pharmaceutical vial can be used for storage of multiple doses of a single pharmaceutical, such as a vaccine, or individual doses of a plurality of pharmaceuticals, such as multiple vaccines, each dose stored in a separate compartment. In some embodiments, each pharmaceutical storage compartment of a multi-compartment pharmaceutical vial includes an approximately equal interior volume. In some embodiments, a multi-compartment pharmaceutical vial includes at least one first pharmaceutical storage compartment with a first interior volume, and at least one second pharmaceutical storage compartment with a second interior volume, wherein the first interior volume and the second interior volume are not equivalent. In some embodiments, a multi-compartment pharmaceutical vial includes a plurality of pharmaceutical storage compartments, each compartment with a pharmaceutical storage volume of less than approximately 5 milliliters (ml). In some embodiments, a multi-compartment pharmaceutical vial includes a plurality of pharmaceutical storage compartments, each compartment with a pharmaceutical storage volume of less than approximately 4 milliliters (ml). In some embodiments, a multi-compartment pharmaceutical vial includes a plurality of pharmaceutical storage compartments, each compartment with a pharmaceutical storage volume of less than approximately 3 milliliters (ml). In some embodiments, a multi-compartment pharmaceutical vial includes a plurality of pharmaceutical storage compartments, each compartment with a pharmaceutical storage volume of less than approximately 2 milliliters (ml). In some embodiments, a multi-compartment pharmaceutical vial includes a plurality of pharmaceutical storage compartments, each compartment with a pharmaceutical storage volume of less than approximately 1 milliliter (ml). In some embodiments, a multi-compartment pharmaceutical vial includes a plurality of pharmaceutical storage compartments, each compartment with a pharmaceutical storage volume of less than approximately 0.5 milliliter (ml).

In some embodiments, a multi-compartment pharmaceutical vial is configured for the transport and storage of a specific number of individual doses of a pharmaceutical intended for use within a limited time period. For example, in some embodiments a multi-compartment pharmaceutical vial including six compartments is configured to store six doses of a particular vaccine, each dose in one of the six compartments, which is equivalent to the estimated number of doses of that vaccine required per day on average at a particular health clinic. In some embodiments, a multi-compartment pharmaceutical vial includes a plurality of pharmaceutical storage compartments of approximately equal interior volume. In some embodiments, a multi-compartment pharmaceutical vial is configured for the transport and storage of a specific number of individual doses of multiple pharmaceuticals intended for use for a single patient within a limited time period, such as a single medical clinic visit. For example, in some embodiments a multi-compartment pharmaceutical vial including four compartments can store four doses of four different vaccines which are generally administered to an individual during a single medical visit. For example, in some embodiments a multi-compartment pharmaceutical vial with six compartments is configured for the storage and transport of a single dose of each of the HepB, RV, DTaP, HiB, PCV13, and IPV vaccines, one in each of the compartments, for administration to a child according to the routine vaccine schedule suggested for 2 month olds. For example, in some embodiments a multi-compartment pharmaceutical vial with four compartments is configured for the storage and transport of a single dose of each of the DTaP, IPV, MMR and VAR vaccines, one in each compartment, for administration to a child according to the routine vaccine schedule suggested for 4-6 year olds. See "Advisory Committee on Immunization Practices (ACIP) Recommended Immunization Schedule for Persons Aged 0 through 18 years—United States, 2013" ACIP Childhood/Adolescent Work Group, *MMWR* 62: 1-8 (2013), which is incorporated herein by reference. For example, in some embodiments a multi-compartment pharmaceutical vial can be used to store multiple doses of immunoglobulin therapy that can be administered in series to a patient as directed by a medical professional. Several types of immunoglobulin therapy are available that are generally administered serially, in dose volumes relative to the body mass of a patient. Aliquot volumes of a immunoglobulin therapy can be stored in separated compartments of a multi-dose vial for administration to patients, in a form to minimize waste of the immunoglobulin therapy as well as to minimize the potential of contamination of the immunoglobulin therapy in the vial. For example, in some embodiments a multi-compartment pharmaceutical vial can be used to store multiple doses of injection-administered anti-viral therapy. For example, in some embodiments a multi-compartment pharmaceutical vial can be used to store multiple doses of injection-administered antibiotic therapy. For example, in some embodiments a multi-compartment pharmaceutical vial can be used to store multiple doses of an injection-administered therapy generally administered to a single patient in series, so that one vial can include a standard series of injectable doses for a single individual patient to be administered in temporal series under the guidance of a medical professional. For example, in some embodiments a multi-compartment pharmaceutical vial can be used to store doses of an injection-administered therapy that has multiple components that are administered separately, for example different antibiotics and/or antivirals that are administered to a single patient in need thereof.

Pharmaceuticals suitable for storage in embodiments of a multi-compartment pharmaceutical vial are pharmaceuticals configured for injection into an individual via a syringe. In some embodiments, a multi-compartment pharmaceutical vial is configured for storage and transport of pharmaceuticals within the cold chain. For example, a multi-compartment pharmaceutical vial may be configured to store pharmaceuticals in a temperature range between 2 degrees Centigrade and 8 degrees Centigrade. For example, a multi-compartment pharmaceutical vial may be configured to store pharmaceuticals in a temperature range between 2 degrees Centigrade and 30 degrees Centigrade. See World Health Organization, "Guidelines on the International Packaging and Shipping of Vaccines" order code WHO/IVB/05.23, printed December 2005, which is incorporated herein by reference. A multi-compartment pharmaceutical vial can store and transport pharmaceuticals intended for injection into humans. A multi-compartment pharmaceutical vial can store and transport pharmaceuticals intended for veterinary injections. Pharmaceuticals can be stored and transported in a liquid form in a multi-compartment pharmaceutical vial prior to injection. Pharmaceuticals can be lyophilized for transport and storage prior to use and then converted into a liquid form within a compartment of the multi-compartment pharmaceutical vial before administration. In some embodiments, a multi-compartment pharmaceutical vial is intended for storage of a lyophilized pharmaceutical, wherein prior to use a medical professional adds diluent, rehydrates the lyophilized material (e.g. by shaking the vial) and subsequently accesses the vial with a syringe needle for injection. In some embodiments, a multi-compartment pharmaceutical vial includes an even number of pharmaceutical storage compartments oriented as linear pairs (e.g. 2×3, 2×4, etc.) wherein one of each of the paired compartments includes a lyophilized pharmaceutical and the other paired compartment includes the appropriate diluent.

In some embodiments, a multi-compartment pharmaceutical vial is configured for storage and transport of vaccines. For example, in some embodiments a multi-compartment pharmaceutical vial can hold multiple doses of a vaccine, each dose stored in an individual compartment prior to administration of the vaccine. In some embodiments, a multi-compartment pharmaceutical vial is a multi-compartment vaccine vial. In some embodiments, a multi-compartment vaccine vial is configured to include a plurality of doses of different vaccines, each dose stored separately in a distinct compartment. In some embodiments, a multi-compartment vaccine vial is configured to include a plurality of doses of the same vaccine, each dose stored separately in a distinct compartment. The multi-compartment pharmaceutical vials can include labels, packaging, and temperature monitors, as appropriate to the contents of the vial. See World Health Organization, "Guidelines on the International Packaging and Shipping of Vaccines" order code WHO/IVB/05.23, printed December 2005, which is incorporated herein by reference.

Isolation of the individual doses of a pharmaceutical into distinct compartments reduces the potential for cross-contamination between different compartments of the multi-compartment pharmaceutical vial. In order to minimize the potential for cross-contamination, the multi-compartment pharmaceutical vial is intended for single-use storage and access in each of the separate compartments. During use, a syringe is inserted into a distinct conduit of the multi-compartment pharmaceutical vial to draw out the single dose of a pharmaceutical stored that that compartment, and after the dose is removed the compartment is not re-accessed to obtain more of the pharmaceutical. A multi-compartment pharmaceutical vial is not configured for re-use or refilling of the separate compartments. Use of a multi-compartment pharmaceutical vial can reduce pharmaceutical waste, such as vaccine waste from multi-dose vials. See Lee et al., "Single versus Multi-Dose Vaccine Vials: An Economic Computational Model," *Vaccine* 38 (32): 5292-5300 (2010), which is incorporated by reference herein.

Depending on the embodiment, a multi-compartment pharmaceutical vial provides at least a two-fold volume reduction over individual single dose pharmaceutical vials while continuing to provide separate compartments for individual doses and in order to minimize the potential for cross-contamination within the vial. A multi-compartment pharmaceutical vial is energy efficient and space efficient during storage and transport, providing a shipping and storage advantage over single-use pharmaceutical vials. For example, multi-dose vials configured with outer walls shaped as regular shapes, such as rectangles or hexagons, can improve packing efficiencies in groups of vials. A multi-compartment pharmaceutical vial provides a weight and volume reduction relative to single-use pharmaceutical vials. The multi-compartment pharmaceutical vial requires less packaging than single-use vials, reducing cost in production as well as the eventual disposal of the vials. Use of multi-compartment vials can reduce the number of vial monitors required during shipment of pharmaceuticals, such as vaccines, within the cold chain. See World Health Organization, "Guidelines on the International Packaging and Shipping of Vaccines" order code WHO/IVB/05.23, printed December 2005, which is incorporated herein by reference. The multi-compartment pharmaceutical vials described herein can be utilized to reduce use of preservatives in vaccines, relative to the required preservative content in multi-dose vials.

Multi-compartment pharmaceutical vials can be fabricated from materials suitable for liquid pharmaceutical storage, depending on the intended pharmaceutical use for a specific vial embodiment. For example, multi-compartment pharmaceutical vials can be fabricated from glass. For example, multi-compartment pharmaceutical vials can be fabricated from plastic, such as polystyrene. In some embodiments, multi-compartment pharmaceutical vials can be fabricated in blow-molded plastic processes. In some embodiments, multi-compartment pharmaceutical vials can be fabricated in blow-fill-seal processes. In some embodiments, multi-compartment pharmaceutical vials can be fabricated in a process to minimize contamination during assembly. See, for example, U.S. Pat. No. 7,707,807, "Apparatus for Molding and Assembling Containers with Stoppers and Filling Same," to Py, which is incorporated herein by reference. In some embodiments, multi-compartment pharmaceutical vials can be fabricated with a formed identification region. See, for example, US Patent Application Publication No. 2012/0104660, "Injection Molding of Micron and Nano Scale Features for Pharmaceutical Brand Protection," to Disawal et al., which is herein incorporated by reference. In some embodiments, multi-compartment pharmaceutical vials are fabricated from translucent or transparent materials. Multi-compartment pharmaceutical vials fabricated from translucent or transparent materials can, for example, provide visibility for a user, such as during removal of a stored pharmaceutical by a syringe. In some embodiments, multi-compartment pharmaceutical vials include a plurality of pharmaceutical storage compartments, wherein each of the pharmaceutical storage compartments is positioned adjacent to at least one outer wall. In some embodiments, multi-compartment pharmaceutical vials include a plurality of pharmaceutical storage compartments, wherein some of the pharmaceutical storage compartments are positioned adjacent to at least one outer wall, and others of the pharmaceutical storage compartments are positioned as adjacent to only one or more interior walls. Multi-compartment pharmaceutical vials fabricated from translucent or transparent materials and wherein each of the pharmaceutical storage compartments is positioned adjacent to at least one outer wall can provide visibility for a user inserting a syringe into the compartment to extract a pharmaceutical stored therein. In some embodiments, multi-compartment pharmaceutical vials can be fabricated from medically acceptable materials, such as polypropylene. In some embodiments, multi-compartment pharmaceutical vials can be fabricated from solid materials that fix the size and shape of the individual compartments individually as well as relative to each other.

In some embodiments, a multi-compartment pharmaceutical vial is fabricated from a rigid material, such as a medically-appropriate glass or plastic material. In an embodiment fabricated from a rigid material, the internal volume of the entire multi-compartment pharmaceutical vial remains fixed prior to use, during use, and after use. In embodiments wherein a multi-compartment pharmaceutical vial is fabricated from a rigid material, the internal volume of each of the plurality of pharmaceutical storage compartments remains constant and does not change when a pharmaceutical storage compartment internally holds a dose of a pharmaceutical or after the pharmaceutical dose has been removed from the pharmaceutical storage compartment.

In some embodiments, a multi-compartment pharmaceutical vial is fabricated from a flexible material, such as a medically-appropriate plastic material. In an embodiment fabricated from a flexible material, the internal volume of the entire multi-compartment pharmaceutical vial can change relative to the amount of material, such as gas and/or liquid, stored in each of the plurality of pharmaceutical storage compartments. For example, each of the plurality of pharmaceutical storage compartments can be configured to deform after removal of a dose of a pharmaceutical stored in the compartment, based on a reduced internal pressure of each of the compartments after removal of the stored pharmaceutical dose from the interior of the compartment. For example, each of the plurality of pharmaceutical storage compartments can be configured to collapse after removal of a dose of a pharmaceutical stored in the compartment. Deflation of a pharmaceutical storage compartment after removal of a stored pharmaceutical dose can, for example, provide a visual indicator to user that the dose has been removed. Deflation of a pharmaceutical storage compartment after removal of a stored pharmaceutical dose can, for example, reduce the storage space required to store the multi-compartment pharmaceutical vial, which may be a significant consideration in some circumstances (e.g. in a situation with limited storage space in the cold chain).

Figure 2:
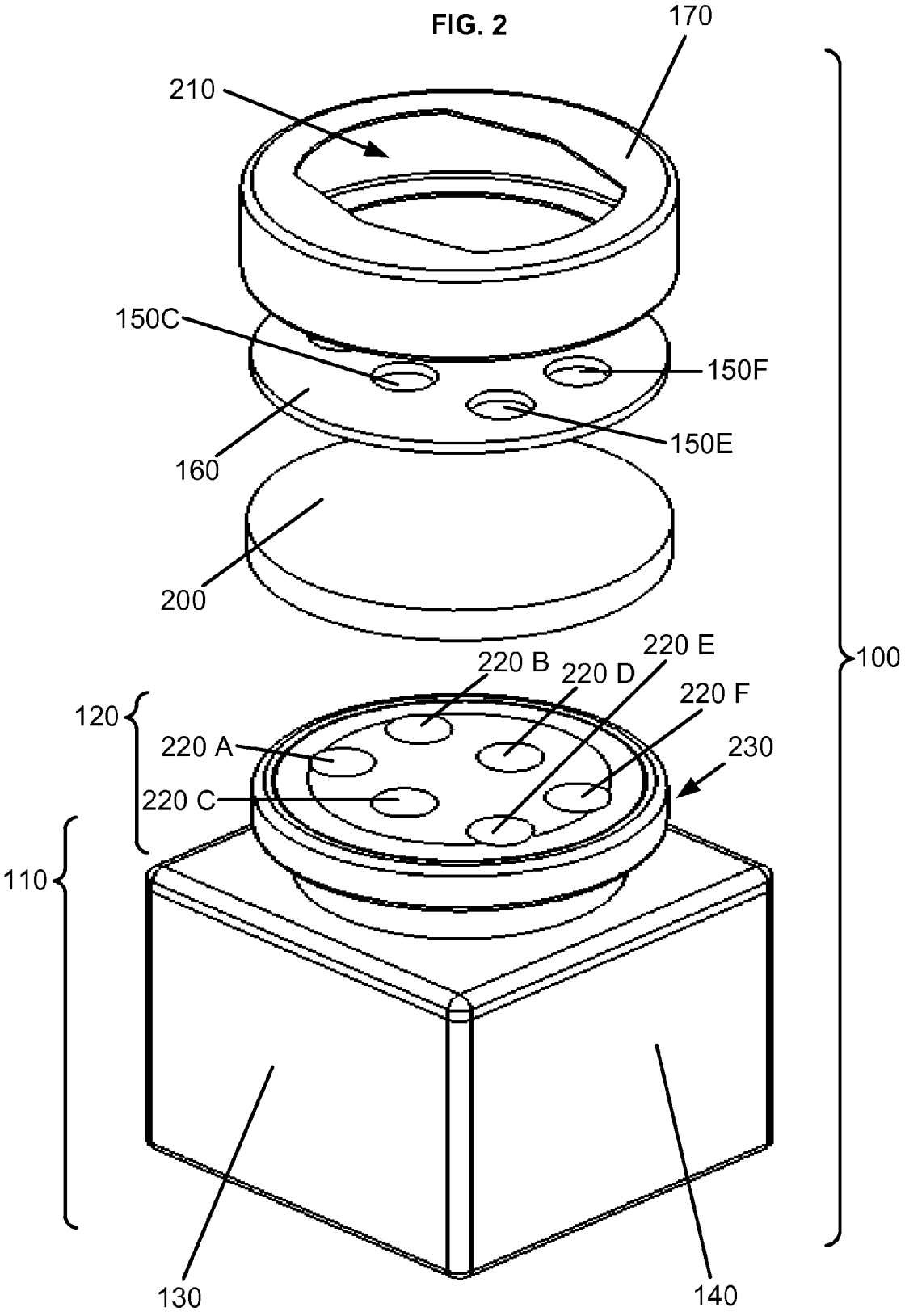
FIG. 2 is a schematic of components of an embodiment of a multi-compartment pharmaceutical vial.

FIG. 2 illustrates aspects of an embodiment of a multi-compartment pharmaceutical vial 100. The multi-compartment pharmaceutical vial 100 includes a multi-compartment storage region 110 and an access region 120. In the embodiment illustrated, the multi-compartment storage region 110 is substantially cubical, with sides 130, 140 of approximately equal dimensions. The access region 120 is a substantially disk-like appendage to the top region of the cubical multi-compartment storage region 110. The multi-compartment storage region 110 and the access region 120 are integral to each other and integrally sealed to each other. In some embodiments, an outer diameter of the multi-compartment pharmaceutical storage region 110 is greater than the outer diameter of the access region 120. As shown in FIG. 2, in some embodiments an outer diameter of the access region 120 is a substantially circular structure. The access region 120 includes an outer surface 230 around a rim region. In some embodiments, an access region 120 includes a rim structure at least partially circumscribing an external perimeter of the access region, the rim structure attached to the external perimeter of the access region. The top of the access region 120 includes a plurality of conduit apertures 220 A, 220 B, 220 C, 220 D, 220 E, 220 F. The plurality of conduit apertures 220 A, 220 B, 220 C, 220 D, 220 E, 220 F are collectively referred to as "conduit apertures 220" with reference to the figures herein. In the embodiment illustrated, the access region includes a single structure including a plurality of conduit apertures attached to individual internal conduits.

In the embodiment illustrated in FIG. 2, a single conduit seal 200 is configured to seal the ends of all of the conduit apertures 220. Some embodiments include a plurality of conduit seals, each configured to seal the end of a single conduit. A conduit seal can be fabricated, for example, from a cured rubber material. See U.S. Pat. No. 7,282,269 "Cured Rubber Components for Use with Pharmaceutical Devices," to Wang and Wong, which is incorporated by reference herein. In some embodiments, an access region includes a plurality of conduits that are internal to a single access structure, wherein each of the conduits includes an end including an aperture, the end projecting outward from the surface of the access structure. An end of a conduit that projects outward from the surface of the access structure can, for example, include an edge region configured to attach a removable cap or seal. Each of the conduit apertures is configured to be sealed with one or more conduit seal.

Some embodiments include: at least one conduit seal 200 configured to mate with a second end 220 of at least one of the plurality of conduits, at least one cover 160 for the conduit seal 220, the cover including cover apertures 150 positioned to expose at least part of the conduit seal 220; and a fastener 170 including a top edge region, a side edge region, and a bottom edge region, each of the regions including an inner face configured to reversibly mate with an outer surface 230 of the access region 120. The embodiment illustrated in FIG. 2 includes a cover 160 with a plurality of cover apertures 150, each of the cover apertures 150 configured to be positioned adjacent to a single conduit aperture 220. The cover 160 and the conduit seal 200 are held in place adjacent to the access region by the fastener 170. The fastener 170 includes a fastener aperture 210 configured to expose the cover 160 at a region surrounding and including the cover apertures 150.

A multi-compartment pharmaceutical vial 100 is configured to retain a seal on each of the conduit apertures 220 throughout the expected use of the multi-compartment pharmaceutical vial 100. In embodiments intended for storage and transport in harsh conditions, such as extended periods of transport within the cold chain, a multi-compartment pharmaceutical vial 100 can be configured to provide stability of the seal. For example, in some embodiments, the conduit seal 200, the cover 160 and the fastener 1700 are fabricated from materials known to be particularly durable in the expected conditions. For example, in some embodiments, the conduit seal 200, the cover 160 and the fastener 1700 are configured for particular durability and toughness. For example, the fastener can be configured to provide a durable crimp around the outer surface of the access region. See, e.g. US Patent Application Publication No. 2009/0016936, "Improved Containers for Pharmaceuticals, Particularly for Use in Radioisotope Laboratories," to Balestracci et al., which is incorporated by reference herein.

Some embodiments include at least one conduit seal that is fabricated from a material that changes color when the material is breached. For example, some embodiments include at least one conduit seal that changes color and is visible to a user when a conduit seal has been previously pierced by a syringe needle or has been damaged during storage and transport. A conduit seal can, for example, be fabricated from a plastic material with a polarized surface, configured to reflect light accordingly. When a conduit seal with a polarized surface is breached, such as through piercing with a syringe or damage, light no longer reflects in the same manner as from an un-breached conduit seal. This change can be visible to a user of the vial. In some embodiments, a conduit seal is fabricated to include a material configured to visually indicate physical damage to the conduit seal. For example, the conduit seal can include a thermoplastic polymer that turns a different color to indicate damage to the polymer. See, e.g. Design News, "Self-Healing Plastic Changes Color When Damaged" by Ann R Thryft, dated Apr. 30, 2012, which is incorporated herein by reference. For example, the conduit seal can include a safety capsule that causes discoloration of the conduit seal when the capsule has been breached. See, e.g. US Patent Application Publication No. 2005/0258129, "Tamper-Proof Closure/Seal for Containers, Particularly Wine Bottles," to Model, which is incorporated herein by reference.

Some embodiments include at least one cover that is fabricated from a material that changes color when the material is breached. For example, some embodiments include at least one cover that changes color and is visible to a user when it has been damaged during storage and transport. A cover can, for example, be fabricated from a plastic or metal material with a polarized surface, configured to reflect light accordingly. When a cover with a polarized surface is breached, such as through damage during transport, light no longer reflects in the same manner as from an un-breached cover. This change can be visible to a user of the vial. In some embodiments, a cover is fabricated to include a material configured to visually indicate physical damage to the cover. For example, a cover can include a thermoplastic polymer that turns a different color to indicate damage to the polymer. See, e.g. Design News, "Self-Healing Plastic Changes Color When Damaged" by Ann R Thryft, dated Apr. 30, 2012, which is incorporated herein by reference. For example, a cover can include a safety capsule that causes discoloration of the cover when the capsule has been breached. See, e.g. US Patent Application Publication No. 2005/0258129, "Tamper-Proof Closure/Seal for Containers, Particularly Wine Bottles," to Model, which is incorporated herein by reference.

Figure 3:
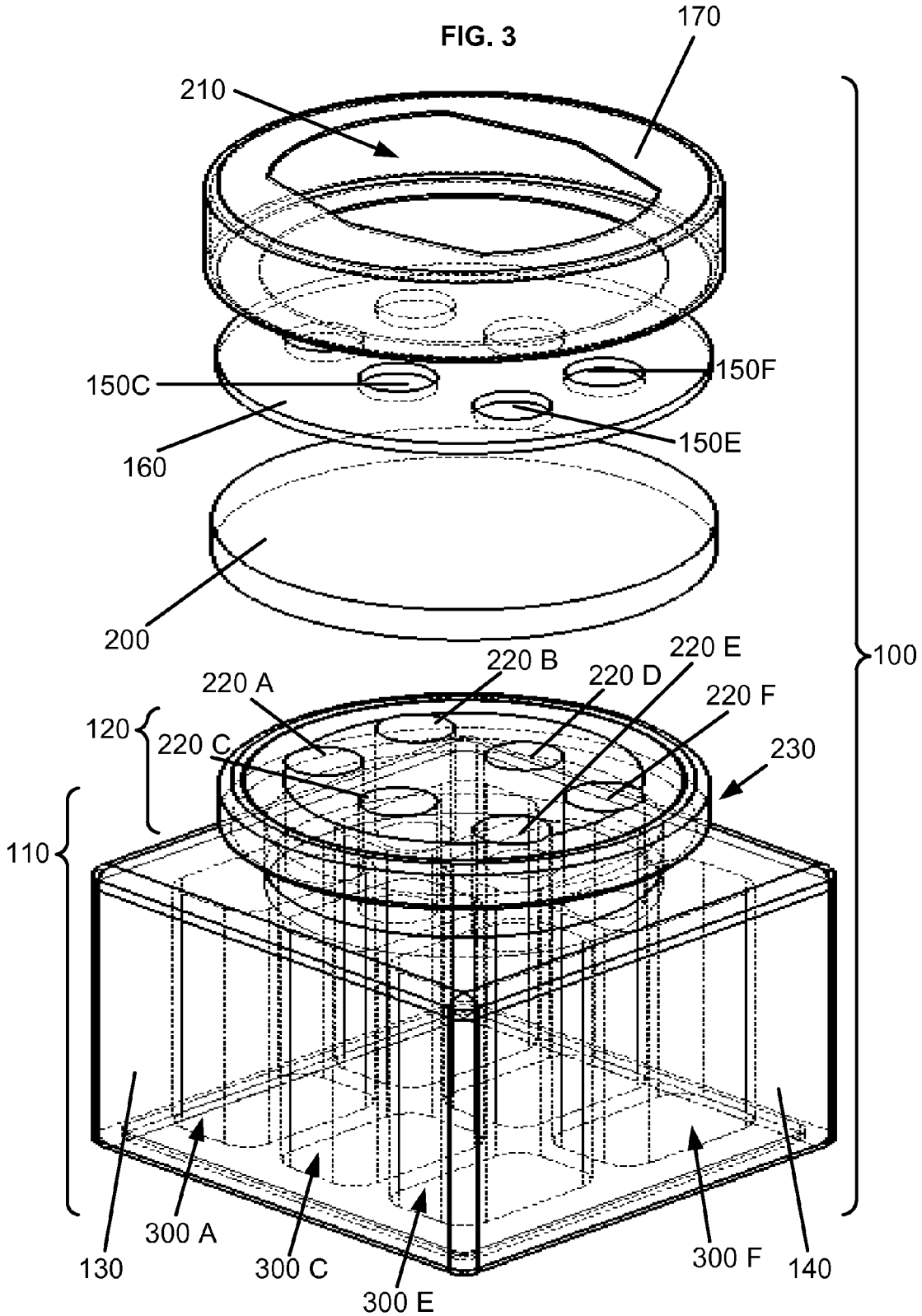
FIG. 3 is a schematic of components of an embodiment of a multi-compartment pharmaceutical vial.

FIG. 3 illustrates an embodiment of a multi-compartment pharmaceutical vial 100 similar to the view shown in FIG. 2. FIG. 3 is drawn to illustrate the internal structures of the components of the embodiment. FIG. 3 illustrates that each of the conduit apertures is the terminal end of a conduit, which connects to a single aperture in a pharmaceutical storage compartment. In the embodiment shown in FIG. 3, the series of conduits are oriented in parallel with each other and with the outer surface 230 of the access region 120. Each of the conduits is attached to the single aperture present at the top edge of a pharmaceutical storage compartment internal to the multi-compartment storage region 110 of the multi-compartment pharmaceutical vial 100. The multi-compartment storage region 110 includes a plurality of pharmaceutical storage compartments 300 A, 300 B, 300 C, 300 D, 300 E, and 300 F positioned in a 2×3 linear array. The plurality of pharmaceutical storage compartments 300 A, 300 B, 300 C, 300 D, 300 E, and 300 F are collectively referred to as "compartments 300" in reference to the figures herein. The compartments 300 are in a fixed position relative to each other, and are not removable or reconfigurable without damage to the integrity of the multi-compartment pharmaceutical vial. A multi-compartment pharmaceutical vial includes a fixed number of pharmaceutical storage compartments at the time of fabrication, and that fixed number is not alterable without damage to the integrity of the multi-compartment pharmaceutical vial.

Each of the compartments 300 is configured with a size and shape to store a single dose of a pharmaceutical, particularly a liquid formulation of a pharmaceutical, in each compartment. Each of the compartments 300 are of a size and shape to contain and store a single dose of a pharmaceutical for injection. In some embodiments, each of the compartments 300 is of a size and shape to store a single dose of liquid, injectable vaccine. Each of the compartments 300 includes a physical configuration to allow a syringe needle to be placed within the compartment at sufficient depth to draw out substantially all of a liquid pharmaceutical stored within the compartment with a syringe and attached needle. As shown in FIG. 3, in some embodiments the compartments are substantially rectangular, with rounded edges of a size and shape to allow a syringe needle to be placed adjacent to a lower corner of the compartment without hindrance to the lateral movement of the syringe needle tip. Some embodiments include a plurality of pharmaceutical storage compartments, each pharmaceutical storage compartment formed with a substantially cylindrical interior surface within the multi-compartment pharmaceutical storage region. The interior volume of each compartment should be sufficient to contain the pharmaceutical as well as an appropriate volume of gas, or "headspace" above the top level of the pharmaceutical. Each of the compartments 300 includes a single aperture at the top edge of the compartment, the aperture connected to a conduit. The conduit and the vertical dimension of each compartment 300 combined is sufficient to store the pharmaceutical, but not greater than a syringe needle can penetrate to extract substantially all of the liquid pharmaceutical in preparation for injection. The space and volume requirements of a specific compartment depend on the embodiment, including the volume of a single dose of the specific pharmaceutical intended for use in the compartment.

In the embodiment depicted in FIG. 3, a single conduit seal 200 is positioned adjacent to the upper surface of the access region 120 in order to seal each of the conduit apertures 220. In some embodiments there are a plurality of conduit seals, each conduit seal placed to seal a single conduit aperture 220. In some embodiments, a conduit seal is configured from a pliable, deformable material configured to deform against the edge of a conduit aperture and retain a gas-impermeable seal. For example, in some embodiments a conduit seal can be fabricated from an elastomeric plastic material. A conduit seal is also fabricated from a material suitable to be pierced by a needle attached to a syringe, in order for a user to obtain the liquid pharmaceutical stored within the compartment.

A cover 160 is positioned adjacent to the at least one conduit seal. In some embodiments, the cover 160 includes a surface configured to reversibly mate with a surface of a conduit seal, and a conduit seal 200 includes a surface configured to reversibly mate with the corresponding surface on the cover 160. A fastener 170 is positioned to hold the cover 160 and the conduit seal 200 in position relative to the access region 120. In some embodiments, a fastener includes a top edge region, a side edge region, and a bottom edge region, each of the regions including an inner face configured to reversibly mate with an outer surface of the access region. As shown in FIG. 3, in some embodiments a fastener includes an aperture 210 of a size, shape and position to permit access to the cover apertures 150 and the adjacent sections of the conduit seal 200.

Figure 4:
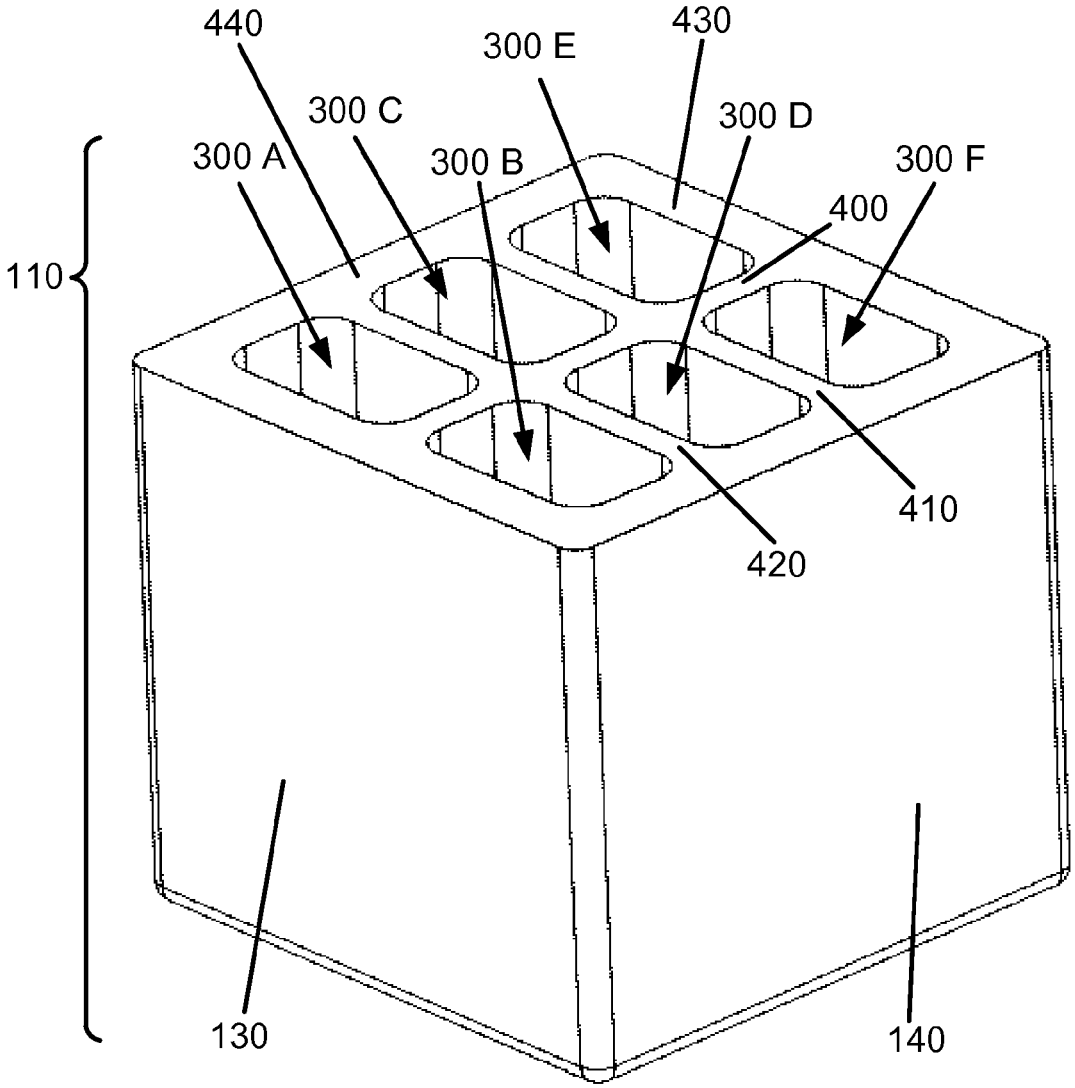
FIG. 4 is a schematic of a section of an embodiment of a multi-compartment pharmaceutical vial.

FIG. 4 illustrates aspects of a multi-compartment storage region 110 in isolation from a multi-compartment pharmaceutical vial in order to depict interior aspects of the multi-compartment storage region 110. FIG. 4 illustrates a multi-compartment storage region 110 including four outer walls 130, 140, 430, 440 arrayed in a rectangular structure. The outer walls 130, 140, 430, 440 are connected and sealed to each other at the corners of the outer walls 130, 140, 430, 440 of the multi-compartment storage region 110. The multi-compartment storage region 110 includes at least one interior wall. In the embodiment illustrated in FIG. 4, the multi-compartment storage region 110 includes interior walls 400, 410, 420 connected at each end, at a substantially perpendicular angle, to an interior surface of the outer walls 130, 140, 430, 440. The interior walls 400, 410, 420 bisect each other to create sealed junctions at substantially perpendicular angles interior to the multi-compartment storage region 110. The combination of the outer walls 130, 140, 430, 440 and the interior walls 400, 410, 420 and their respective sealed junctions form a plurality of compartments 300 within the multi-compartment storage region 110. Each of the junctions between walls forms a substantially sealed intersection. In some embodiments, the interior walls and the outer walls have similar dimensions, including thicknesses. In some embodiments, the interior walls and the outer walls have different dimensions, including thicknesses.

In some embodiments, the multi-compartment storage region includes four outer walls oriented to form a first substantially rectangular structure; and wherein the plurality of interior walls are positioned to separate the first substantially rectangular structure into a plurality of pharmaceutical storage compartments with substantially rectangular structures. In some embodiments, the multi-compartment storage region includes an even number of outer walls positioned to form a regular polygon structure; and an even number of interior walls, each positioned to bisect the interior of the regular polygon structure to form the plurality of pharmaceutical storage compartments of substantially equivalent size. In some embodiments, the multi-compartment storage region includes four outer walls oriented to form a first substantially rectangular structure; and wherein the plurality of interior walls include a central wall positioned to divide the first substantially rectangular structure into two second substantially rectangular structures, and at least one spacing wall positioned to divide each of the second substantially rectangular structures into two third pharmaceutical storage compartments with substantially rectangular structures. In some embodiments, the interior surfaces of the outer walls and the interior walls are curvilinear, to create interior pharmaceutical storage compartments with rounded sides and/or edges.

For example, in the embodiment illustrated in FIG. 4, three of the outer walls 440, 130, 140 in combination with an interior wall 420 form a substantially rectangular structure with substantially right angle corners at the sealed junctions between the outer walls 440, 130, 140 and the interior wall 420. This substantially rectangular structure is bisected approximately in half with a second interior wall 400 that is oriented at substantially right angles to the first interior wall 420. The combination of the outer walls 440, 130, 140 and the interior walls 420, 400 form two adjacent compartments 300 A, 300 B within the interior of the multi-compartment storage region 110. Similarly, two opposing outer walls 140, 440 in combination with two interior walls 410, 420 oriented at substantially right angles create a rectangular structure within the center of the multi-compartment storage region 110. This structure is bisected, approximately at a midpoint, by an interior wall 400 to create two compartments 300 C, 300 D. Two more compartments 300 E, 300 F are created by the combination of three outer walls 440, 430, 140 and interior walls 400, 410. The resulting multi-compartment storage region 110 includes six compartments oriented as a substantially linear 2×3 array. In some embodiments, a multi-compartment storage region 110 includes more or less than six interior compartments. In some embodiments, the multi-compartment storage region 110 includes an even number of interior pharmaceutical storage compartments, arrayed as a paired linear array.

Figure 5:
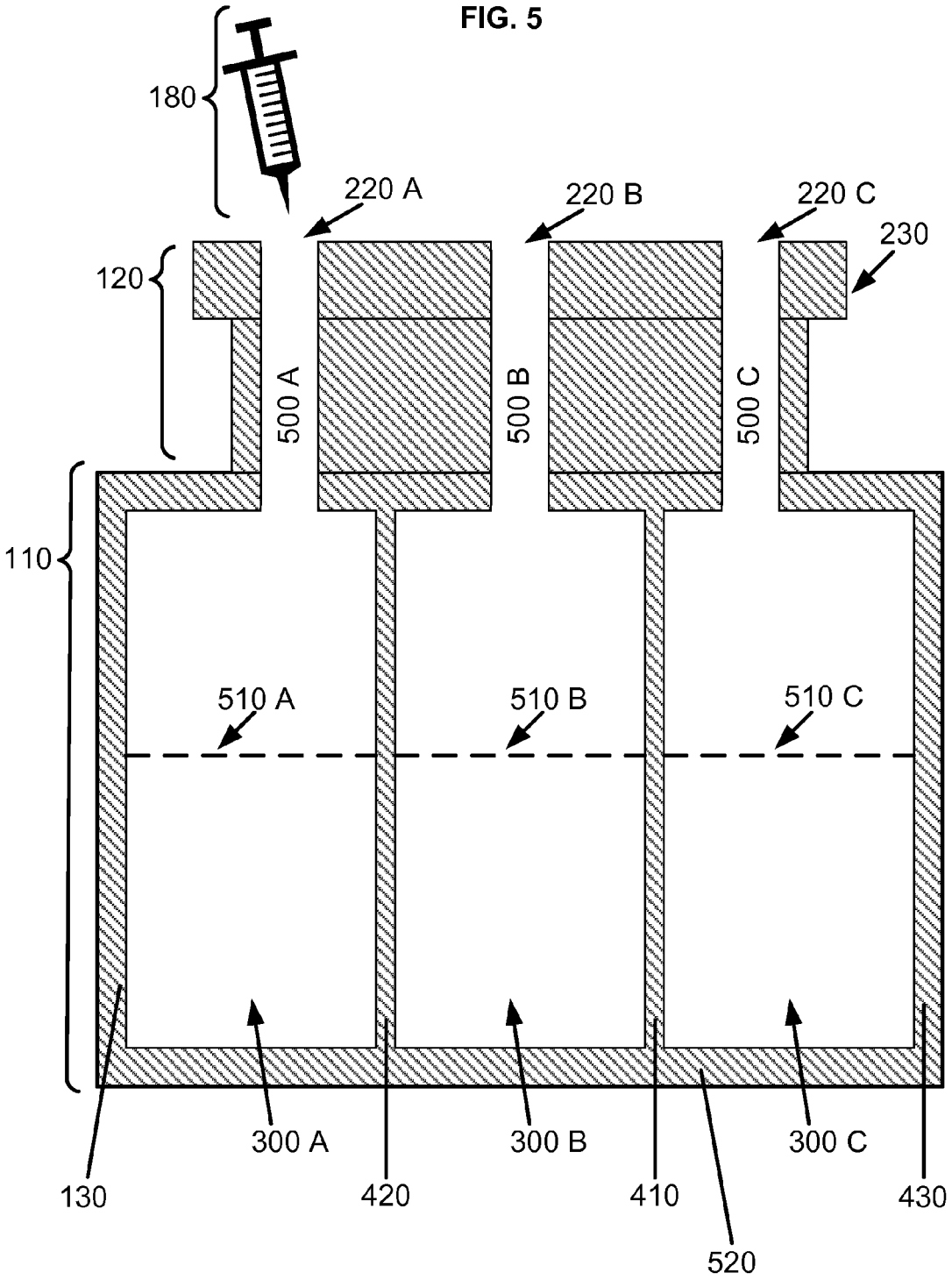
FIG. 5 is a cross-section view of a section of an embodiment of a multi-compartment pharmaceutical vial.

FIG. 5 illustrates a cross-section view through an embodiment of a multi-compartment pharmaceutical vial. As shown in FIG. 5, the multi-compartment pharmaceutical vial includes a multi-compartment storage region 110 and an access region 120. The multi-compartment storage region 110 includes outer walls 130, 430 as an outer boundary to the vial. The multi-compartment storage region 110 includes interior walls 410, 420 that divide the interior of the multi-compartment storage region 110 into compartments 300. In the view shown in FIG. 5, the multi-compartment pharmaceutical vial is depicted as a cross-section view vertically through the vial, and only three compartments 300 A, 300 B, 300 C are visible, however the embodiment can include at least three more compartments, configured in a 2×3 linear array such as shown in FIG. 4. In some embodiments, the compartments are arrayed as linear pairs, or a 2×N configuration, where N is an integer greater than 1.

The access region 120 includes a plurality of conduits 500, each with a first end and a second end, wherein the first end of each conduit 500 is connected to one aperture in a pharmaceutical storage compartment, and the second end of each conduit circumscribes an aperture 220 positioned opposite to the bottom wall 520. The plurality of conduits 500 A, 500 B, 500 C are collectively referred to as "conduits 500" with reference to the figures herein. Each of the compartments 300 includes a conduit 500 attached to an aperture at the top edge of the compartment. For example, the left-side compartment 300 A has an attached conduit 500 A, with a distal aperture 220 A, traversing the access region 120. For example, the center compartment 300 B has an attached conduit 500 B, with a distal aperture 220 B, traversing the access region 120. For example, the right-side compartment 300 C has an attached conduit 500 C, with a distal aperture 220 C, traversing the access region 120.

The internal dimensions of the conduit apertures 220, conduits 500 and compartments 300 are of a size and shape that a syringe 180 can be used to put a syringe needle through the length of the conduit to remove substantially all of a liquid pharmaceutical stored within the compartment 300. The syringe 180 shown in FIG. 5 is not to scale. The distance between a conduit aperture 220 and a space below an approximate fill line 510 is a distance that can be traversed by a syringe needle. For example, in the view shown in FIG. 5, the length between the conduit aperture 220 A, through the long axis of the attached conduit 500 A, and under the fill line 510 A in the attached compartment 300 A is a length that can be traversed with a standard length injection needle attached to a syringe 180. Depending on the embodiment and the intended use, an approximate fill line 510 can be estimated for each compartment based on the volume of a single dose of a liquid pharmaceutical and the interior dimensions of the compartment. For example, the left-side compartment 300 A has an internal fill line 510 A, the center compartment 300 B has an internal fill line 510 B, and the right-side compartment 300 C has internal fill line 510 C in the embodiment shown in FIG. 5. The plurality of fill lines 510 A, 510 B, 510 C are collectively referred to as "fill lines 510" with reference to the figures herein.

In the embodiment shown in FIG. 5, each of the compartments has a fill line 510 at approximately the same level. Some embodiments include fill lines at different positions relative to the vertical sides of the compartment. The space below the fill line 510 is the volume that is expected to be filled with liquid pharmaceutical for storage within the compartment. The space above the fill line 510, often referred to as "headspace," is filled with gas during storage of a liquid pharmaceutical in a compartment.

Figure 6:
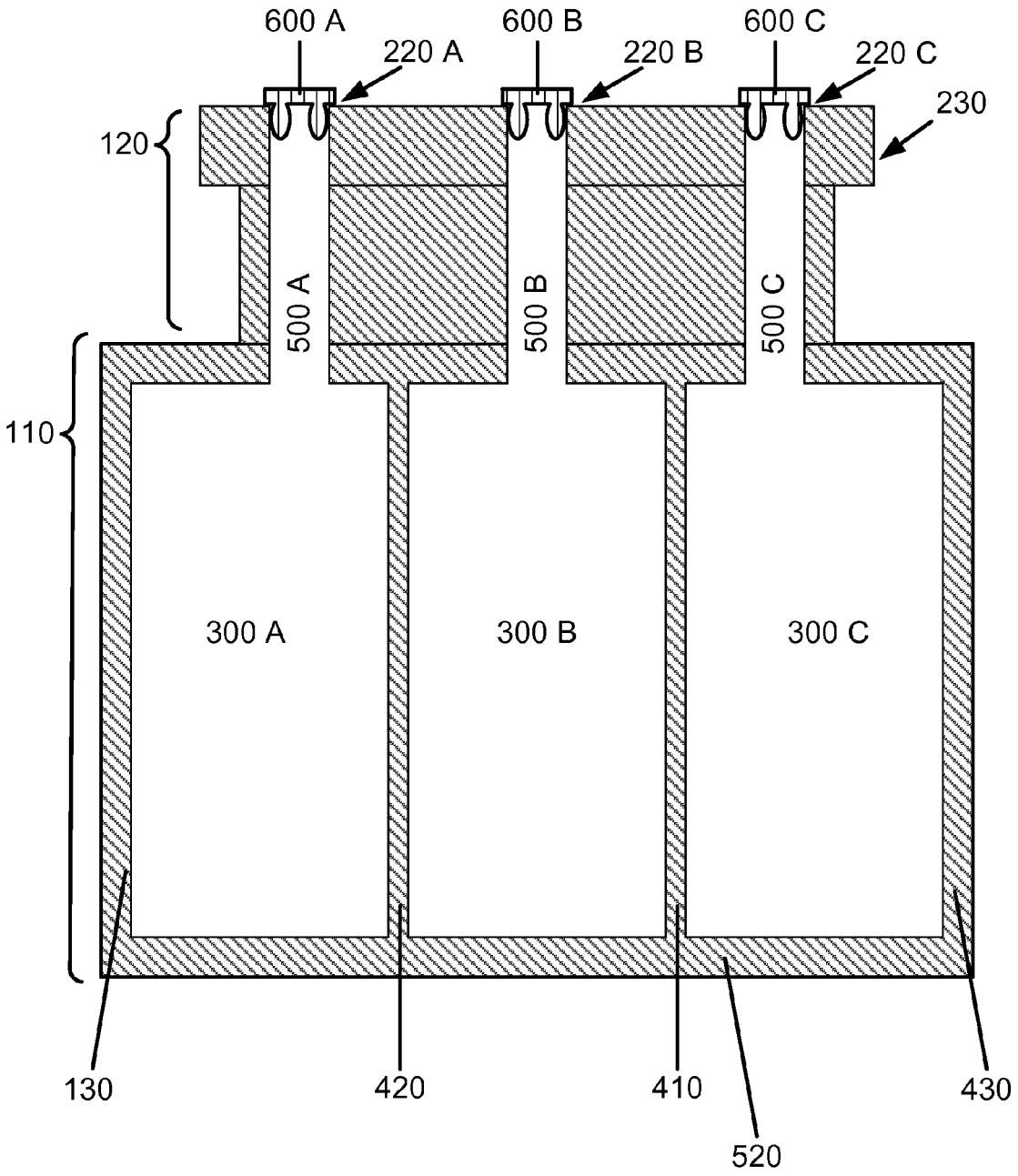
FIG. 6 is a cross-section view of a section of an embodiment of a multi-compartment pharmaceutical vial.

FIG. 6 illustrates a cross-section view of an embodiment of a multi-compartment pharmaceutical vial. The multi-compartment pharmaceutical vial includes a multi-compartment storage region 110 and an access region 120. The multi-compartment storage region 110 includes outer walls 130, 430 as an outer boundary to the vial. The multi-compartment storage region 110 includes interior walls 410, 420 that divide the interior of the multi-compartment storage region 110 into compartments 300. In the illustration of FIG. 6, the multi-compartment pharmaceutical vial is depicted as a cross-section view vertically through the vial, and only three compartments 300 A, 300 B, 300 C are visible, however the embodiment can include additional compartments not shown in the view presented in FIG. 6.

FIG. 6 illustrates that each of the compartments 300 is substantially sealed, with a single aperture positioned in a region near the top of the compartment 300 when the vial is in a substantially upright position. The single aperture is connected to a single conduit 500. The conduits 500 are oriented substantially in parallel through the vertical length of the access region 120 when the vial is in a substantially upright position. Each of the conduits 500 has an access aperture 220. In the embodiment illustrated in FIG. 6, each of the access apertures 220 has an associated cover 600. The plurality of covers 600 A, 600 B, 600 C are collectively referred to as "covers 600" with reference to the figures herein.

Each of the covers 600 includes flanges that project into the associated conduit 500 and hold the cover in place relative to the access aperture 220 of that conduit. Each of the covers 600 creates a substantially gas-impermeable seal between the interior of the adjacent conduit 500 and the space external to the access region 120. Some embodiments include additional covers on the exterior of the access region 120, the additional covers positioned and configured to protect the covers 600 during transport and storage, for example to maintain the gas-impermeable seal made by each cover on its associated conduit 500. Some embodiments include at least one fastener on the exterior of the access region 120, which may be crimped around the edge surface 230 of the access region 120. In embodiments including at least one fastener, it is positioned and configured to protect the covers 600 during transport and storage while allowing for access into the associated conduit 500 and compartment 300 by a syringe needle when needed for use, such as preparation for injection of a liquid pharmaceutical into a patient.

Figure 7:
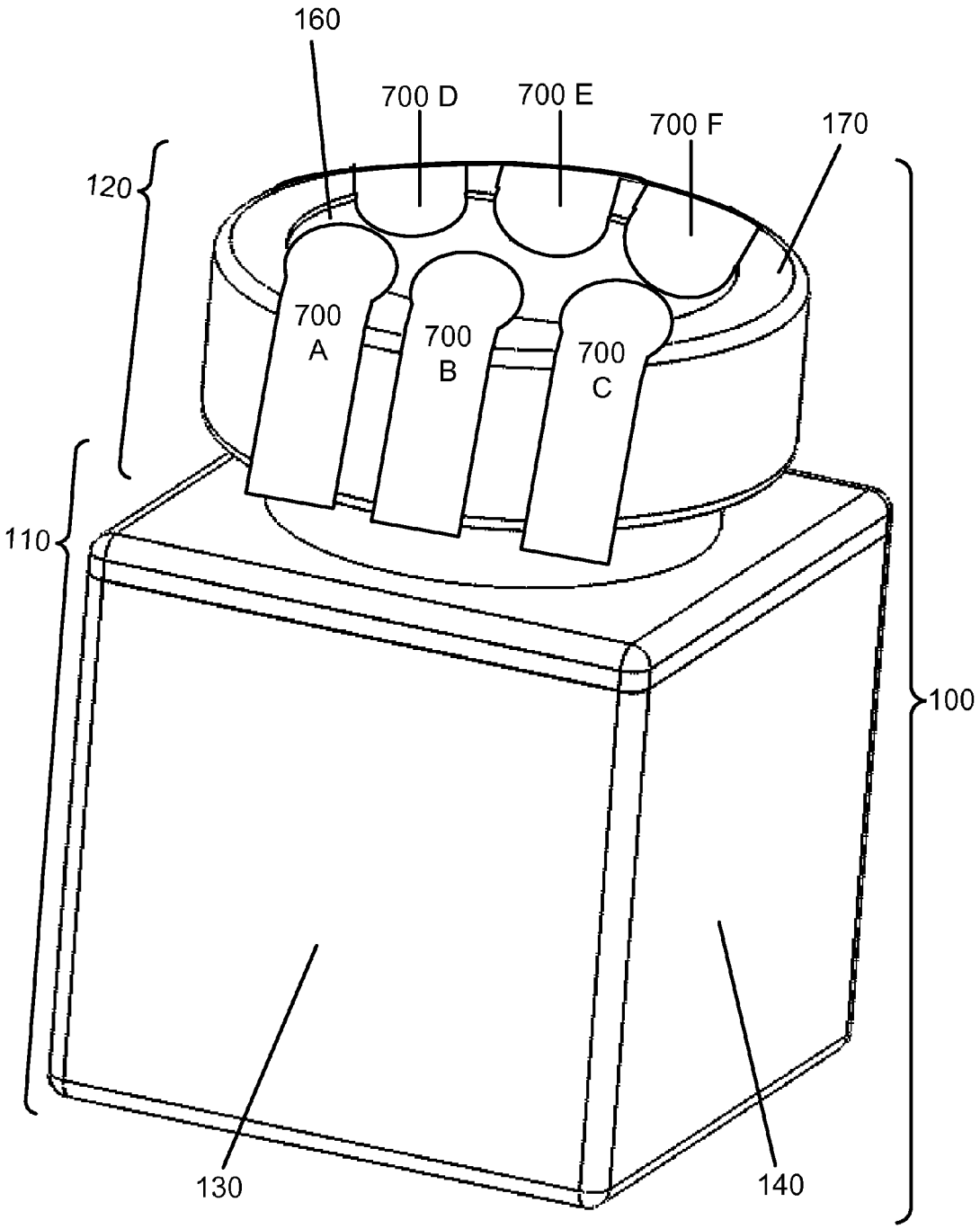
FIG. 7 is a schematic of an embodiment of a multi-compartment pharmaceutical vial.

FIG. 7 illustrates an embodiment of a multi-compartment pharmaceutical vial 100, including a multi-compartment storage region 110 and an access region 120. The embodiment shown in FIG. 7 includes a multi-compartment storage region 110 that is substantially cubical, including faces 130, 140 of substantially similar dimensions. The multi-compartment storage region 110 is attached to an access region 120, including six internal conduits and attached access apertures at the top face of the access region 120. The top face of the access region has a cover 160 including six cover apertures corresponding to the position of the access apertures and attached conduits. A conduit seal is positioned between the lower surface of the cover 160 and the outer surface of the access region 120 adjacent to each access aperture. The cover seal is secured in place with the cover 160 to create a gas-impermeable seal between the interior of each conduit and space external to the multi-compartment pharmaceutical vial 100. The cover 160 is held in position by a fastener 170 that curves around the outer edge of the access region 120.

The embodiment of a multi-compartment pharmaceutical vial 100 shown in FIG. 7 is illustrated as configured for storage and transport of the multi-compartment pharmaceutical vial 100. The embodiment illustrated includes a plurality of access tabs 700. The plurality of access tabs 700 A, 700 B, 700 C, 700 D, 700E, 700 F are collectively referred to as "access tabs 700" with reference to the figures herein. Each access tab 700 is a substantially planar structure with one end covering an access aperture and one end projecting outward from the access region 120 at the lower region of the access region 120. The access tabs 700 are fabricated from thin material, such as a durable paper, plastic sheet, or a combined paper-plastic sheet. The access tabs 700 are secured to the cover 160 and the fastener 170 with a removable adhesive. Each access tab 700 includes a region configured to cover a conduit seal over an access aperture before use of the multi-compartment pharmaceutical vial 100. Each access tab 700 also includes a protruding section, such as an opposite end, that is configured for a user to grasp to remove the access tab before accessing the contents of the multi-compartment pharmaceutical vial 100. See U.S. Pat. No. 4,527,703, "Flexible Sterile Closure System for Containers" to Cummings, which is incorporated herein by reference.

In the embodiment shown in FIG. 7, the access tabs 700 are configured as substantially elongated rectangular planar structures, with a circular edge at the end covering the conduit seal. The specific configuration of an access tab depends on the size and shape of the associated multi-compartment pharmaceutical vial, such as the size and shape of the access apertures and associated conduit seals, the size and shape of the access region, and the required durability in a particular embodiment.

At the time of use of the multi-compartment pharmaceutical vial 100, a user grasps the protruding end of the access tab 700 and pulls to remove the entire access tab 700 from the access region 120. This exposes the conduit seal over an access aperture, and the user can then use a syringe to remove the single dose of liquid pharmaceutical stored in the adjacent compartment. The access tabs provide protection from external contaminants at the surface of the conduit seal over an access aperture, such as from dust and dirt, during storage and transport of multiple doses of pharmaceutical within the multi-compartment pharmaceutical vial 100. The removal of each access tab just before use also provides an easily-visible visual reminder of which compartments of a multi-compartment pharmaceutical vial have had their individual pharmaceutical doses removed, and correspondingly which compartments still include a dose of liquid pharmaceutical.

Figure 8:
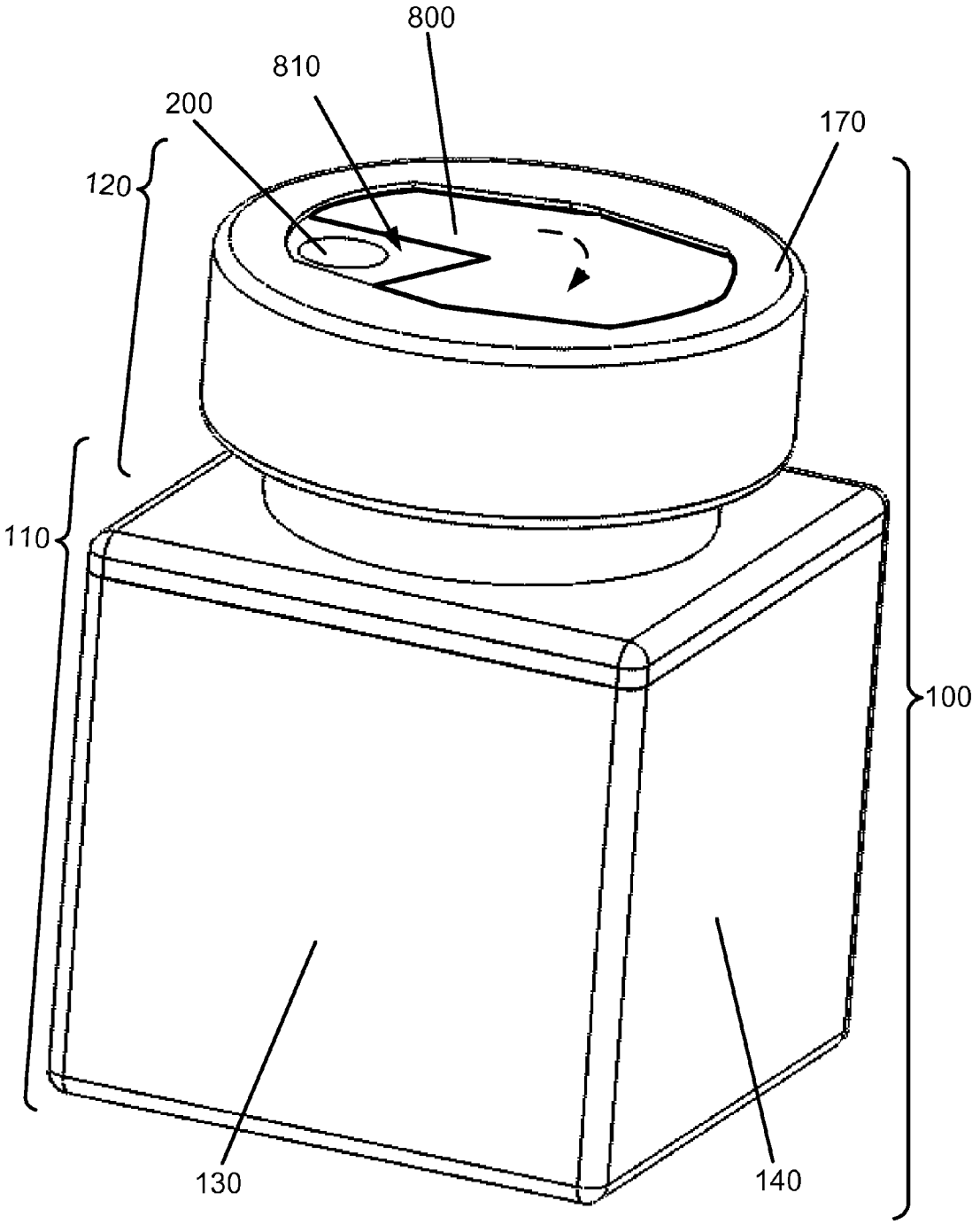
FIG. 8 is a schematic of an embodiment of a multi-compartment pharmaceutical vial.

FIG. 8 illustrates an embodiment of a multi-compartment pharmaceutical vial 100. The multi-compartment pharmaceutical vial 100 shown in FIG. 8 includes a multi-compartment storage region 110 and an access region 120. The access region 120 includes a plurality of access apertures. Each of the access apertures is formed at a second end of a conduit, while the first end of the conduit is attached to a single aperture in a compartment internal to the multi-compartment storage region 110, the compartment configured to store a single dose of a liquid pharmaceutical. In some embodiments, a plurality of conduit seals are sequentially exposed during rotation of a cover 800 including an aperture 810 configured to expose a single conduit seal 200 at any given time. The vial can include a fastener 170 configured to maintain the cover 800 in position adjacent to the top surface of the access region 120, including the conduit seals, while permitting the cover 800 to rotate or move sufficiently to expose each of the conduit seals sequentially during use of the multi-compartment pharmaceutical vial 100.

The embodiment illustrated in FIG. 8 includes: at least one conduit seal configured to mate with the second end of each of the plurality of conduits in the access region 120; at least one substantially planar and circular cover 800 for the at least one conduit seal, the cover including an aperture 810 positioned to expose at least part of the at least one conduit seal 150, the cover 800 including an upper surface and a lower surface; and a fastener 170 including a top edge region including an inner surface configured to reversibly mate with the top surface of the cover 800, and a side edge region and a bottom edge region, each including an inner surface configured to reversibly mate with an outer surface of the access region 120. In some embodiments, the cover includes a series of ratchet teeth attached to an outer edge of the cover. The outer edge of the cover can be, in some embodiments, the edge of the cover distal to a center of the cover. Some embodiments also include at least one pawl attached to the inner surface of the fastener, the pawl configured to reversibly mate with the series of ratchet teeth, wherein the pawl is positioned to engage with the series of ratchet teeth and restrict rotation of the cover when the fastener and the cover are in place adjacent to the multi-compartment pharmaceutical vial. Some embodiments can also include a flange on the cover and a corresponding flange on the fastener, the flanges positioned to mate together when the cover and fastener are in a single orientation, and to not permit rotation of the cover further.

During use, a user of the multi-compartment pharmaceutical vial 100 can turn the cover 800 sufficiently to expose each conduit seal 200 sequentially within the region of the aperture 810 in the cover 800. The user can traverse each of the exposed conduit seals once with a single injection needle attached to a syringe to remove the single dose of liquid pharmaceutical stored in the particular compartment accessible from that particular conduit seal. Once the first dose has been removed, a user can turn the cover to expose a second conduit seal and access the compartment attached via a conduit to the second conduit seal. The cover assists a user to visualize the specific conduit seal to pierce with the syringe needle at a single time, sequentially. In embodiments including a series of ratchet teeth attached to an outer edge of the cover and a pawl positioned to reversibly mate with the ratchet teeth, the cover can be rotated in only one direction (e.g. clockwise or counter-clockwise) by a user, providing assurance that each of the compartments is accessed with a syringe needle in series. Some embodiments include flange structures attached to the cover and the fastener, the flanges configured to allow only a single rotation of the cover. In such embodiments, the cover and the ratchet mechanism blocks a user from accessing each of the conduit seals after the cover has rotated beyond a set point, thereby blocking a user from accidentally accessing a compartment more than once.

Figure 9:
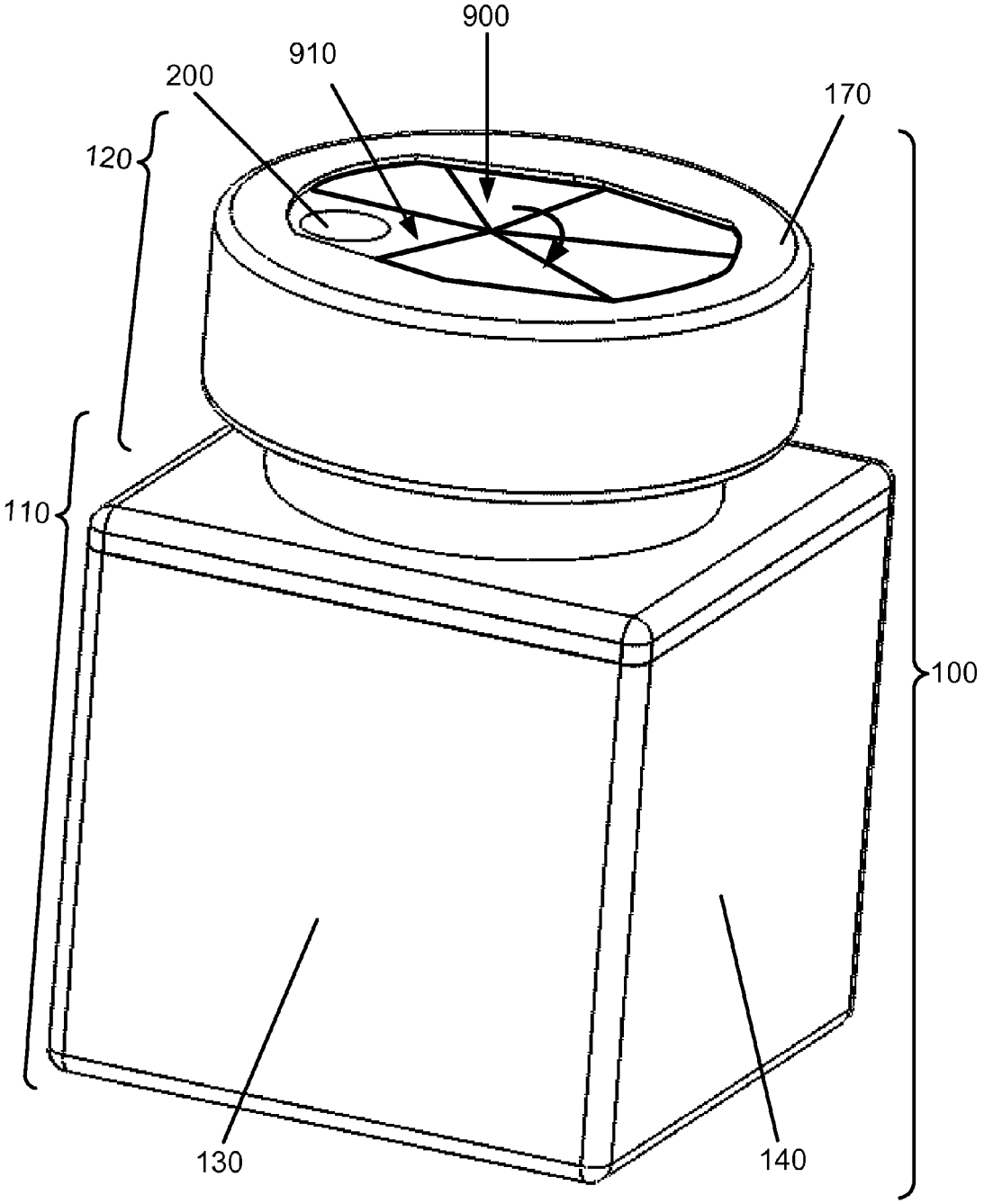
FIG. 9 is a schematic of an embodiment of a multi-compartment pharmaceutical vial.

FIG. 9 depicts an embodiment of a multi-compartment pharmaceutical vial 100. The embodiment of a multi-compartment pharmaceutical vial 100 illustrated in FIG. 9 includes a multi-compartment storage region 110 and an access region 120. The access region 120 includes a plurality of access apertures. Each of the access apertures is formed at a second end of a conduit, while the first end of the conduit is attached to a single aperture in a compartment internal to the multi-compartment storage region 110, the compartment configured to store a single dose of a liquid pharmaceutical. In some embodiments, a plurality of conduit seals are sequentially exposed when a cover 900 including a plurality of individual sections form an aperture 910 configured to expose a single conduit seal 200 at any given time. The vial can include a fastener 170 configured to maintain the cover 800 in position adjacent to the top surface of the access region 120, including the conduit seals, while permitting the cover 800 to rotate or move sufficiently to expose each of the conduit seals sequentially during use of the multi-compartment pharmaceutical vial 100.

The embodiment shown in FIG. 9 includes: at least one conduit seal 200 configured to mate with the second end of each of the plurality of conduits; a cover 900 for the at least one conduit seal 200, the cover a plurality of overlapping planar structures, each including an upper surface and a lower surface; and a fastener 170 including a top edge region including an inner surface configured to reversibly mate with the top surface of the cover, and a side edge region and a bottom edge region, each including an inner surface configured to reversibly mate with an outer surface of the access region 120. Some embodiments include at least one ratchet tooth attached to the distal edge of each of the plurality of overlapping planar structures, and at least one pawl attached to the inner surface of the fastener, the pawl configured to reversibly mate with each of the at least one ratchet tooth on each of the plurality of overlapping planar structures, wherein the pawl is positioned to engage with the each of the at least one ratchet tooth and restrict rotation of the cover when the fastener and the cover are in place adjacent to the multi-compartment pharmaceutical vial.

During use, a user of the multi-compartment pharmaceutical vial 100 can turn at least one of the planar structures of the cover 900 sufficiently to expose each conduit seal 200 sequentially within an aperture 910 in the cover 900. The user can inject a single injection needle attached to a syringe through each of the exposed conduit seals once to remove the single dose of liquid pharmaceutical stored in the particular compartment accessible from that particular conduit seal. Once the first dose has been removed, a user can manually move at least one of the planar structures of the cover 900 to expose a second conduit seal and access the compartment attached via a conduit to the second conduit seal. The cover 900 assists a user to visualize a specific conduit seal to pierce with the syringe needle at a single time, while allowing for exposure of each of the conduit seals as needed by the user. In embodiments including a series of ratchet teeth attached to an outer edge of each of the planar structures of the cover and a pawl positioned to reversibly mate with the ratchet teeth, the cover can be rotated in only one direction (e.g. clockwise or counter-clockwise) by a user, providing assurance that each of the compartments is accessed with a syringe needle in series. Some embodiments include flange structures attached to each of the planar structures of the cover and the fastener, the flanges configured to restrict rotation of the cover. In such embodiments, the flange structures attached to each of the planar structures of the cover and the ratchet mechanism blocks a user from accessing each of the conduit seals after the cover has rotated beyond a set point, thereby blocking a user from accidentally accessing a compartment more than once.

Figure 10:
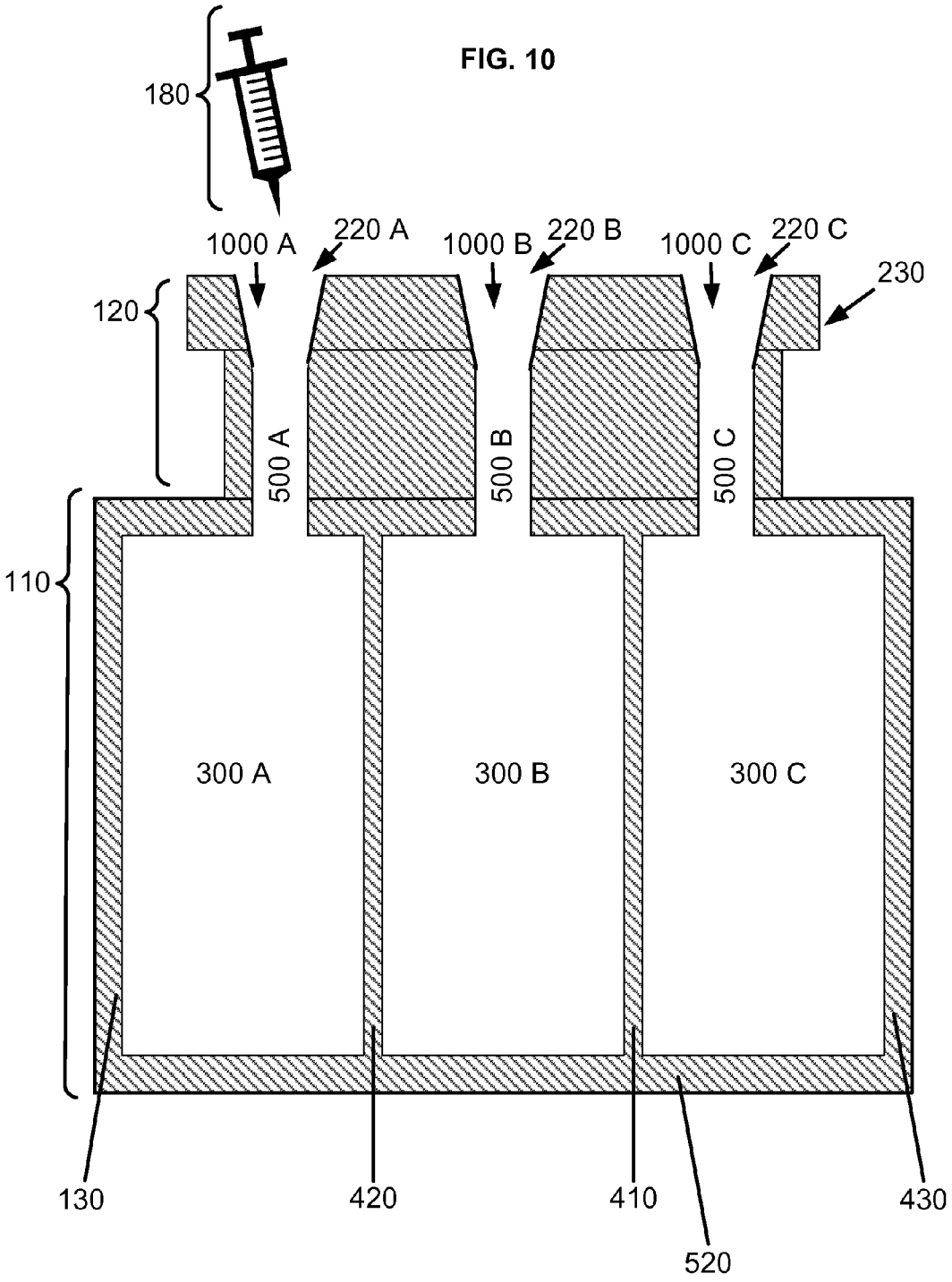
FIG. 10 is a cross-section view of a section of an embodiment of a multi-compartment pharmaceutical vial.

FIG. 10 illustrates a cross-section view of a multi-compartment pharmaceutical vial 100. The multi-compartment pharmaceutical vial 100 includes a multi-compartment storage region 110 and an access region 120. The access region 120 includes a plurality of access apertures 220, each formed by the end of a conduit 500 between a single aperture in an internal compartment 300 and the exterior of the top of the access region 120. The view illustrates two outer walls 130, 430 on the two sides of the multi-compartment pharmaceutical vial 100, and two interior walls 410, 420 between the compartments 300 within the multi-compartment storage region 110 of the multi-compartment pharmaceutical vial 100. The multi-compartment pharmaceutical vial 100 includes a bottom wall 520 across the lower edge of the multi-compartment pharmaceutical vial 100. For purposes of illustration, the embodiment illustrated in FIG. 10 does not include conduit seals positioned adjacent to the access apertures 220, however during use of the multi-compartment pharmaceutical vial 100 to store and transport pharmaceuticals, each of the access apertures would be associated with a gas-impermeable conduit seal.

In the embodiment illustrated in FIG. 10, each of the plurality of access apertures 220 is the external terminal end of a conduit 500. Each of the conduits 500 includes an enlarged terminal region 1000 at a region adjacent to the access aperture 220. The plurality of enlarged terminal regions 1000 A, 1000 B, 1000 C are collectively referred to as "enlarged terminal regions 1000" with reference to the figures herein. The enlarged terminal regions 1000 can, for example, be formed as substantially conical shapes at the end of a conduit 500. In some embodiments, the enlarged terminal regions 1000 are configured to allow a needle attached to a syringe 180 to be positioned within the conduit 500 and the attached compartment 300 at an angle advantageous for withdrawal of a single dose of a liquid pharmaceutical stored within the compartment 300.

Some embodiments include a multi-compartment sample vial configured for the storage of multiple individual patient samples within the cold chain in a space-efficient manner. For example, some embodiments include a multi-compartment sample vial configured for the storage of multiple individual patient blood samples taken in series to be kept within the cold chain during storage and potential transport to another location for analysis. Some embodiments include a multi-compartment sample vial configured for the storage of multiple biological samples taken from an individual. For example, biological samples such as blood, urine, feces, saliva, sputum, and nasopharyngeal fluid taken from an individual can be stored within a multi-compartment sample vial within the cold chain prior to biochemical analysis (e.g. for disease status or infection indicators). Some embodiments include a multi-compartment sample vial configured for the storage of multiple biological samples taken from multiple individuals (e.g. multiple blood samples taken from a number of different individuals). Some embodiments include a multi-compartment sample vial including: a multi-compartment biological sample storage region including a bottom wall, at least one outer wall and at least one interior wall, the bottom wall, the at least one outer wall and the at least one interior wall forming a plurality of sample biological storage compartments, each biological storage compartment including an aperture positioned opposite to the bottom wall of the biological storage region; an access region attached to the biological storage region, the access region including a plurality of conduits, each with a first end and a second end, wherein the first end of each conduit is connected to one aperture in a biological storage compartment, and the second end of each conduit circumscribes an aperture positioned opposite to the bottom wall; and at least one conduit seal configured to be reversibly mated with at least one second end of one of the plurality of conduits; and a cover with a surface configured to be reversibly mated with outer surface of the access region and a surface of the at least one conduit seal. A cover can be configured to be attached to the access region of the multi-compartment sample vial and to maintain a position of the conduit seal after one or more compartments within the vial are used to store biological samples. For example, a cover can be configured to be crimped on to an exterior surface of the access region prior to storage of the vial within the cold chain, and potential transport within the cold chain.

Some embodiments include methods for space-efficient storage of multiple biological samples within the cold chain, including: placement of a first biological sample within a first compartment of a multi-compartment sample vial; placement of a second biological sample within a second compartment of the multi-compartment sample vial; placement of at least one conduit seal over the conduit aperture attached to the first compartment and the conduit aperture attached to the second compartment; and securing a cover over the at least one conduit seal in a manner to expect a liquid-impermeable seal formed by the at least one conduit seal to remain in place. The multi-compartment sample vial can then be stored and/or transported within the cold chain prior to removal of the cover and access of the compartments, in order to carry out a biochemical analysis of the first biological sample and the second biological sample. In some embodiments, a multi-compartment sample vial includes a plurality of compartments, such as 3, 4, 5, 6, 7, 8, 9 or 10 individual compartments as required for the storage situation of a particular embodiment. Each compartment of a multi-compartment sample vial can be configured to hold, for example, less than approximately 0.5 mL of a biological sample. Each compartment of a multi-compartment sample vial can be configured to hold, for example, less than approximately 1 mL of a biological sample. Each compartment of a multi-compartment sample vial can be configured to hold, for example, less than approximately 2 mL of a biological sample. Each compartment of a multi-compartment sample vial can be configured to hold, for example, less than approximately 3 mL of a biological sample. Each compartment of a multi-compartment sample vial can be configured to hold, for example, less than approximately 4 mL of a biological sample. Each compartment of a multi-compartment sample vial can be configured to hold, for example, less than approximately 5 mL of a biological sample.

While particular aspects of the present subject matter described herein have been shown and described, it will be apparent to those skilled in the art that, based upon the teachings herein, changes and modifications may be made without departing from the subject matter described herein and its broader aspects and, therefore, the appended claims are to encompass within their scope all such changes and modifications as are within the true spirit and scope of the subject matter described herein. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to claims containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that typically a disjunctive word and/or phrase presenting two or more alternative terms, whether in the description, claims, or drawings, should be understood to contemplate the possibilities of including one of the terms, either of the terms, or both terms unless context dictates otherwise. For example, the phrase "A or B" will be typically understood to include the possibilities of "A" or "B" or "A and B."

Some embodiments include a multi-compartment sample vial configured for the storage of multiple individual patient samples within the cold chain in a space-efficient manner. For example, some embodiments include a multi-compartment sample vial configured for the storage of multiple individual patient blood samples taken in series to be kept within the cold chain during storage and potential transport to another location for analysis. Some embodiments include a multi-compartment sample vial configured for the storage of multiple biological samples taken from an individual. For example, biological samples such as blood, urine, feces, sputum, and nasopharyngeal fluid taken from an individual can be stored within a multi-compartment sample vial within the cold chain prior to analysis (e.g. for disease status or infection indicators). Some embodiments include a multi-compartment sample vial configured for the storage of multiple biological samples taken from multiple individuals (e.g. multiple blood samples taken from a number of different individuals). Some embodiments include a multi-compartment sample vial including: a multi-compartment biological sample storage region including a bottom wall, at least one outer wall and at least one interior wall, the bottom wall, the at least one outer wall and the at least one interior wall forming a plurality of sample biological storage compartments, each biological storage compartment including an aperture positioned opposite to the bottom wall of the biological storage region; an access region attached to the biological storage region, the access region including a plurality of conduits, each with a first end and a second end, wherein the first end of each conduit is connected to one aperture in a biological storage compartment, and the second end of each conduit circumscribes an aperture positioned opposite to the bottom wall; and at least one conduit seal configured to be reversibly mated with at least one second end of one of the plurality of conduits; and a cover with a surface configured to be reversibly mated with outer surface of the access region and a surface of the at least one conduit seal. A cover can be configured to be attached to the access region of the multi-compartment sample vial and to maintain a position of the conduit seal after one or more compartments within the vial are used to store biological samples. For example, a cover can be configured to be crimped on to an exterior surface of the access region prior to storage of the vial within the cold chain, and potential transport within the cold chain.

All of the above U.S. patents, U.S. patent application publications, U.S. patent applications, foreign patents, foreign patent applications and non-patent publications referred to in this specification and/or listed in any Application Data Sheet, are incorporated herein by reference, to the extent not inconsistent herewith.

Aspects of the subject matter described herein are set out in the following numbered clauses:

1. In some embodiments, a multi-compartment pharmaceutical vial includes: a multi-compartment pharmaceutical storage region including a bottom wall, at least one outer wall and at least one interior wall, the bottom wall, the at least one outer wall and the at least one interior wall forming a plurality of pharmaceutical storage compartments, each pharmaceutical storage compartment including an aperture positioned opposite to the bottom wall of the pharmaceutical storage region; and an access region attached to the pharmaceutical storage region, the access region including a plurality of conduits, each with a first end and a second end, wherein the first end of each conduit is connected to one aperture in a pharmaceutical storage compartment, and the second end of each conduit circumscribes an aperture positioned opposite to the bottom wall.
2. Some embodiments include a multi-compartment pharmaceutical vial as in paragraph 1, wherein the multi-compartment pharmaceutical storage region and the access region are integrally sealed to each other.
3. Some embodiments include a multi-compartment pharmaceutical vial as in paragraph 1, wherein the multi-compartment pharmaceutical storage region includes: four outer walls oriented to form a first substantially rectangular structure; and wherein the at least one interior wall includes a central wall positioned to divide the first substantially rectangular structure into two second substantially rectangular structures, and at least one spacing wall positioned to divide each of the second substantially rectangular structures into two third pharmaceutical storage compartments with substantially rectangular structures.
4. Some embodiments include a multi-compartment pharmaceutical vial as in paragraph 1, wherein the multi-compartment pharmaceutical storage region includes: four outer walls oriented to form a first substantially rectangular structure; and wherein the at least one interior wall is positioned to separate the first substantially rectangular structure into a plurality of pharmaceutical storage compartments with substantially rectangular structures.
5. Some embodiments include a multi-compartment pharmaceutical vial as in paragraph 1, wherein each of the plurality of pharmaceutical storage compartments include approximately equal interior volume.
6. Some embodiments include a multi-compartment pharmaceutical vial as in paragraph 1, wherein the plurality of pharmaceutical storage compartments include: an even number of pharmaceutical storage compartments, arrayed as linear pairs.
7. Some embodiments include a multi-compartment pharmaceutical vial as in paragraph 1, wherein each of the plurality of pharmaceutical storage compartments is positioned adjacent to at least one outer wall.
8. Some embodiments include a multi-compartment pharmaceutical vial as in paragraph 1, including at least one first pharmaceutical storage compartment with a first interior volume, and at least one second pharmaceutical storage compartment with a second interior volume, wherein the first interior volume and the second interior volume are not equivalent.
9. Some embodiments include a multi-compartment pharmaceutical vial as in paragraph 1, wherein each of the plurality of pharmaceutical storage compartments includes a pharmaceutical storage volume less than approximately 1 milliliter.
10. Some embodiments include a multi-compartment pharmaceutical vial as in paragraph 1, wherein each of the plurality of pharmaceutical storage compartments includes a pharmaceutical storage volume less than approximately 0.5 milliliter.
11. Some embodiments include a multi-compartment pharmaceutical vial as in paragraph 1, wherein the multi-compartment pharmaceutical storage region includes: an even number of outer walls positioned to form a regular polygon structure; and an even number of interior walls, each positioned to bisect the interior of the regular polygon structure to form the plurality of pharmaceutical storage compartments of substantially equivalent size.
12. Some embodiments include a multi-compartment pharmaceutical vial as in paragraph 1, wherein the multi-compartment pharmaceutical storage region includes: a plurality of pharmaceutical storage compartments, each pharmaceutical storage compartment formed with a substantially cylindrical interior surface within the multi-compartment pharmaceutical storage region.
13. Some embodiments include a multi-compartment pharmaceutical vial as in paragraph 1, wherein an outer diameter of the multi-compartment pharmaceutical storage region is greater than an outer diameter of the access region.
14. Some embodiments include a multi-compartment pharmaceutical vial as in paragraph 1, wherein an outer diameter of the access region is a substantially circular structure.
15. Some embodiments include a multi-compartment pharmaceutical vial as in paragraph 1, wherein the access region includes: a rim structure at least partially circumscribing an external perimeter of the access region, the rim structure attached to the external perimeter of the access region.
16. Some embodiments include a multi-compartment pharmaceutical vial as in paragraph 1, wherein the plurality of conduits include: a second end of each conduit including an enlarged terminal region positioned adjacent to the aperture.

17. Some embodiments include a multi-compartment pharmaceutical vial as in paragraph 1, further including: at least one conduit seal configured to mate with the second end of at least one of the plurality of conduits; at least one cover for the conduit seal, the cover including an aperture positioned to expose at least part of the conduit seal; and a fastener including a top edge region, a side edge region, and a bottom edge region, each of the regions including an inner face configured to reversibly mate with an outer surface of the access region.

18. Some embodiments include a multi-compartment pharmaceutical vial as in paragraph 1, further including: at least one conduit seal configured to mate with the second end of each of the plurality of conduits; at least one substantially planar and circular cover for the at least one conduit seal, the cover including an aperture positioned to expose at least part of the conduit seal, the cover including an upper surface and a lower surface; and a fastener including a top edge region including an inner surface configured to reversibly mate with the top surface of the cover, and a side edge region and a bottom edge region, each including an inner surface configured to reversibly mate with an outer surface of the access region.

19. Some embodiments include a multi-compartment pharmaceutical vial as in paragraph 1, further including: a series of ratchet teeth attached to an outer edge of the at least one substantially planar and circular cover; and at least one pawl attached to the inner surface of the fastener, the pawl configured to reversibly mate with the series of ratchet teeth, wherein the pawl is positioned to engage with the series of ratchet teeth and restrict rotation of the cover when the fastener and the at least one substantially planar and circular cover are in place adjacent to the multi-compartment pharmaceutical vial.

20. Some embodiments include a multi-compartment pharmaceutical vial as in paragraph 1, further including: at least one conduit seal configured to mate with the second end of each of the plurality of conduits; a cover for the at least one conduit seal, the cover including a plurality of overlapping planar structures, each including an upper surface and a lower surface, each planar structure including a distal edge; and a fastener including a top edge region including an inner surface configured to reversibly mate with the top surface of the cover, and a side edge region and a bottom edge region, each including an inner surface configured to reversibly mate with an outer surface of the access region.

21. Some embodiments include a multi-compartment pharmaceutical vial as in paragraph 1, further including: at least one ratchet tooth attached to the distal edge of each of the plurality of overlapping planar structures; and at least one pawl attached to the inner surface of the fastener, the pawl configured to reversibly mate with each of the at least one ratchet tooth on each of the plurality of overlapping planar structures, wherein the pawl is positioned to engage with the each of the at least one ratchet tooth and restrict rotation of the cover when the fastener and the cover are in place adjacent to the multi-compartment pharmaceutical vial.

22. Some embodiments include a multi-compartment pharmaceutical vial as in paragraph 1, further including: at least one conduit seal configured to mate with the second end of each of the plurality of conduits, the conduit seal fabricated with a light-polarizing material at a surface location of the conduit seal opposing the end of the conduit.

23. Some embodiments include a multi-compartment pharmaceutical vial as in paragraph 1, further including: at least one conduit seal configured to mate with the second end of each of the plurality of conduits, the conduit seal fabricated including material configured to visually indicate damage at a surface location of the conduit seal opposing the end of the conduit.

24. Some embodiments include a multi-compartment pharmaceutical vial as in paragraph 1, further including: at least one conduit seal configured to mate with the second end of each of the plurality of conduits; and a removable access tab including a first region positioned over one of the at least one conduit seal, and a second region configured to facilitate removal of the removable access tab.

25. In some embodiments, a multi-compartment pharmaceutical vial includes: a multi-compartment pharmaceutical storage region, including a bottom wall, at least one outer wall, and at least one interior wall, the walls forming at least two pharmaceutical storage compartments, each of the at least two pharmaceutical storage compartments including an aperture at a position distal to the bottom wall; an access region attached to the pharmaceutical storage region, the access region including a plurality of conduits with a first end and a second end, wherein the first end of each conduit is connected to one aperture in a pharmaceutical storage compartment, and wherein the second end of each conduit forms an aperture positioned opposite to the bottom wall, the access region including an outer surface; at least one conduit seal, each of the at least one conduit seal reversibly mated with at least one second end of one of the plurality of conduits; and a cover with a surface reversibly mated with outer surface of the access region and a surface of the at least one conduit seal.

26. Some embodiments include a multi-compartment pharmaceutical vial as in paragraph 25, wherein the multi-compartment pharmaceutical storage region and the access region are integrally sealed to each other.

27. Some embodiments include a multi-compartment pharmaceutical vial as in paragraph 25, wherein the multi-compartment pharmaceutical storage region includes: four outer walls oriented as a first rectangle; and wherein the at least one interior wall includes a central wall positioned to divide the first rectangle into two second rectangles, and at least one spacing wall positioned to divide each of the second rectangles into two third rectangles.

28. Some embodiments include a multi-compartment pharmaceutical vial as in paragraph 25, wherein each of the at least two pharmaceutical storage compartments include approximately equal interior volume.

29. Some embodiments include a multi-compartment pharmaceutical vial as in paragraph 25, wherein the at least two pharmaceutical storage compartments include: an even number of pharmaceutical storage compartments, arrayed as linear pairs.

30. Some embodiments include a multi-compartment pharmaceutical vial as in paragraph 25, wherein each of the at least two pharmaceutical storage compartments is positioned adjacent to at least one outer wall.

31. Some embodiments include a multi-compartment pharmaceutical vial as in paragraph 25, including at least one pharmaceutical storage compartment with a first interior volume, and at least one pharmaceutical storage compartment with a second interior volume, wherein the first interior volume and the second interior volume are not equivalent.

32. Some embodiments include a multi-compartment pharmaceutical vial as in paragraph 25, wherein each of the at least two pharmaceutical storage compartments includes a pharmaceutical storage volume less than approximately 1 milliliter.

33. Some embodiments include a multi-compartment pharmaceutical vial as in paragraph 25, wherein each of the at least two pharmaceutical storage compartments includes a pharmaceutical storage volume less than approximately 0.5 milliliter.

34. Some embodiments include a multi-compartment pharmaceutical vial as in paragraph 25, wherein the multi-compartment pharmaceutical storage region includes: an even number of outer walls positioned as a regular polygon; and an even number of interior walls, each positioned to bisect the interior of the regular polygon to form the plurality of pharmaceutical storage compartments of substantially equivalent size.

35. Some embodiments include a multi-compartment pharmaceutical vial as in paragraph 25, wherein the multi-compartment pharmaceutical storage region includes: a plurality of pharmaceutical storage compartments, each pharmaceutical storage compartment formed with a substantially cylindrical interior surface within the multi-compartment pharmaceutical storage region.

36. Some embodiments include a multi-compartment pharmaceutical vial as in paragraph 25, wherein the outer diameter of the multi-compartment pharmaceutical storage region is greater than the outer diameter of the access region.

37. Some embodiments include a multi-compartment pharmaceutical vial as in paragraph 25, wherein the outer diameter of the access region is substantially circular.

38. Some embodiments include a multi-compartment pharmaceutical vial as in paragraph 25, wherein the access region includes: a flange at least partially circumscribing an external perimeter of the access region.

39. Some embodiments include a multi-compartment pharmaceutical vial as in paragraph 25, wherein the access region includes: a second end of each conduit including an enlarged terminal region positioned adjacent to the aperture.

40. Some embodiments include a multi-compartment pharmaceutical vial as in paragraph 25, wherein the conduit seal includes: a light-polarizing material at a surface location of the conduit seal adjacent to the second end of the conduit.

41. Some embodiments include a multi-compartment pharmaceutical vial as in paragraph 25, wherein the conduit seal includes: a material configured to visually indicate physical damage to the conduit seal.

42. Some embodiments include a multi-compartment pharmaceutical vial as in paragraph 25, wherein the cover includes: a material configured to visually indicate physical damage to the cover.

43. Some embodiments include a multi-compartment pharmaceutical vial as in paragraph 25, further including: a removable access tab including a first region positioned over one of the at least one conduit seal, and a second region configured to facilitate removal of the removable access tab.

44. Some embodiments include a multi-compartment pharmaceutical vial as in paragraph 25, further including: a fastener including a top edge region including an inner surface configured to reversibly mate with the top surface of the cover, and a side edge region and a bottom edge region, each including an inner surface configured to reversibly mate with an outer surface of the access region.

45. Some embodiments include a multi-compartment pharmaceutical vial as in paragraph 25, further including: a series of ratchet teeth attached to an outer edge of the cover; and at least one pawl attached to the inner surface of the fastener, the pawl configured to reversibly mate with the series of ratchet teeth, wherein the pawl is positioned to engage with the series of ratchet teeth and restrict rotation of the cover when the fastener and the cover are in place adjacent to the multi-compartment pharmaceutical vial.

46. In some embodiments, a multi-compartment pharmaceutical vial includes: a multi-compartment pharmaceutical storage region, including a bottom wall, at least one outer wall, and at least one interior wall, the walls forming an even number of pharmaceutical storage compartments, each of the pharmaceutical storage compartments including a single aperture at a position distal to the bottom wall, and each of the pharmaceutical storage compartments positioned adjacent to the at least one outer wall; an access region including an outer surface, the access region attached to the pharmaceutical storage region, the access region including a plurality of conduits with a first end and a second end, wherein the first end of each conduit is connected to the single aperture in a pharmaceutical storage compartment, and wherein the second end of each conduit forms an aperture positioned opposite to the bottom wall; at least one conduit seal, each of the at least one conduit seal reversibly mated with at least one second end of one of the plurality of conduits; and a cover with a surface reversibly mated with outer surface of the access region and a surface of the at least one conduit seal.

47. Some embodiments include a multi-compartment pharmaceutical vial as in paragraph 46, wherein the multi-compartment pharmaceutical storage region and the access region are integrally sealed to each other.

48. Some embodiments include a multi-compartment pharmaceutical vial as in paragraph 46, wherein the multi-compartment pharmaceutical storage region includes: four outer walls oriented as a first rectangle; and wherein the at least one interior wall includes a central wall positioned to divide the first rectangle into two second rectangles, and at least one spacing wall positioned to divide each of the second rectangles into two third rectangles.

49. Some embodiments include a multi-compartment pharmaceutical vial as in paragraph 46, wherein each of the even number of pharmaceutical storage compartments include approximately equal interior volume.

50. Some embodiments include a multi-compartment pharmaceutical vial as in paragraph 46, wherein the even number of pharmaceutical storage compartments are arrayed as linear pairs.

51. Some embodiments include a multi-compartment pharmaceutical vial as in paragraph 46, wherein the even number of pharmaceutical storage compartments include: at least one first pharmaceutical storage compartment with a first interior volume, and at least one second pharmaceutical storage compartment with a second interior volume, wherein the first interior volume and the second interior volume are not equivalent.

52. Some embodiments include a multi-compartment pharmaceutical vial as in paragraph 46, wherein the even number of pharmaceutical storage compartments include: an interior pharmaceutical storage volume less than approximately 1 milliliter.

53. Some embodiments include a multi-compartment pharmaceutical vial as in paragraph 46, wherein the even number of pharmaceutical storage compartments include: an interior pharmaceutical storage volume less than approximately 0.5 milliliter.

54. Some embodiments include a multi-compartment pharmaceutical vial as in paragraph 46, wherein the multi-compartment pharmaceutical storage region includes: an even number of outer walls positioned to form a regular polygon structure; and an even number of interior walls, each positioned to bisect the interior of the regular polygon structure to form the even number of pharmaceutical storage compartments.

55. Some embodiments include a multi-compartment pharmaceutical vial as in paragraph 46, wherein the even number of pharmaceutical storage compartments include: a substantially cylindrical interior surface of each of the even number of pharmaceutical storage compartments within the multi-compartment pharmaceutical storage region.

56. Some embodiments include a multi-compartment pharmaceutical vial as in paragraph 46, wherein the outer diameter of the multi-compartment pharmaceutical storage region is greater than the outer diameter of the access region.

57. Some embodiments include a multi-compartment pharmaceutical vial as in paragraph 46, wherein the outer diameter of the access region is a substantially circular structure.

58. Some embodiments include a multi-compartment pharmaceutical vial as in paragraph 46, wherein the access region includes: a rim structure at least partially circumscribing an external perimeter of the access region, the rim structure attached to the external perimeter of the access region.

59. Some embodiments include a multi-compartment pharmaceutical vial as in paragraph 46, wherein the access region includes: a second end of each conduit including an enlarged terminal region positioned adjacent to the aperture.

60. Some embodiments include a multi-compartment pharmaceutical vial as in paragraph 46, wherein each of the plurality of conduits are substantially cylindrical in shape.

61. Some embodiments include a multi-compartment pharmaceutical vial as in paragraph 46, wherein the at least one conduit seal includes: a light-polarizing material at a surface location of the conduit seal adjacent to the second end of the conduit.

62. Some embodiments include a multi-compartment pharmaceutical vial as in paragraph 46, wherein the at least one conduit seal includes: a material configured to visually indicate physical damage to the conduit seal.

63. Some embodiments include a multi-compartment pharmaceutical vial as in paragraph 46, wherein the cover includes: a material configured to visually indicate physical damage to the cover.

64. Some embodiments include a multi-compartment pharmaceutical vial as in paragraph 46, further including: a removable access tab including a first region positioned over one of the at least one conduit seal, and a second region configured to facilitate removal of the removable access tab.

65. Some embodiments include a multi-compartment pharmaceutical vial as in paragraph 46, further including: a fastener including a top edge region including an inner surface configured to reversibly mate with the top surface of the cover, and a side edge region and a bottom edge region, each including an inner surface configured to reversibly mate with an outer surface of the access region.

66. Some embodiments include a multi-compartment pharmaceutical vial as in paragraph 46, further including: a series of ratchet teeth attached to an outer edge of the cover; and at least one pawl attached to the inner surface of the fastener, the pawl configured to reversibly mate with the series of ratchet teeth, wherein the pawl is positioned to engage with the series of ratchet teeth and restrict rotation of the cover when the fastener and the cover are in place adjacent to the multi-compartment pharmaceutical vial.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A multi-compartment pharmaceutical vial comprising:

a multi-compartment pharmaceutical storage region including a bottom wall, at least one outer wall and at least one interior wall, the bottom wall, the at least one outer wall and the at least one interior wall forming a plurality of pharmaceutical storage compartments, each pharmaceutical storage compartment including an aperture positioned opposite to the bottom wall of the pharmaceutical storage region; and an access region attached to the pharmaceutical storage region, the access region including a plurality of conduits, each with a first end and a second end, wherein the first end of each conduit is connected to one aperture in a pharmaceutical storage compartment, and the second end of each conduit circumscribes an access aperture positioned opposite to the bottom wall;

at least one conduit seal configured to mate with the second end of at least one of the plurality of conduits; and at least one cover separate and removable from the at least one conduit seal, the at least one cover being positioned over the at least one conduit seal and including an cover aperture positioned to expose at least part of the at least one conduit seal.

2. The multi-compartment pharmaceutical vial of claim 1, wherein the multi-compartment pharmaceutical storage region and the access region are integrally sealed to each other.

3. The multi-compartment pharmaceutical vial of claim 1, wherein the multi-compartment pharmaceutical storage region comprises:

four outer walls oriented to form a first substantially rectangular structure; and wherein the at least one interior wall includes a central wall positioned to divide the first substantially rectangular structure into two second substantially rectangular structures, and at least one spacing wall positioned to divide each of the second substantially rectangular structures into two separate pharmaceutical storage compartments with substantially rectangular structures.

4. The multi-compartment pharmaceutical vial of claim 1, wherein the multi-compartment pharmaceutical storage region comprises:

four outer walls oriented to form a first substantially rectangular structure; and wherein the at least one interior wall is positioned to separate the first substantially rectangular structure into a plurality of pharmaceutical storage compartments with substantially rectangular structures.

5. The multi-compartment pharmaceutical vial of claim 1, the plurality of pharmaceutical storage compartments comprise:

an even number of pharmaceutical storage compartments, arrayed as linear pairs.

6. The multi-compartment pharmaceutical vial of claim 1, wherein the multi-compartment pharmaceutical storage region comprises:

a plurality of pharmaceutical storage compartments, each pharmaceutical storage compartment formed with a substantially cylindrical interior surface within the multi-compartment pharmaceutical storage region.

7. The multi-compartment pharmaceutical vial of claim 1, wherein an outer diameter of the multi-compartment pharmaceutical storage region is greater than an outer diameter of the access region.

8. The multi-compartment pharmaceutical vial of claim 1, wherein the access region comprises:

a rim structure at least partially circumscribing an external perimeter of the access region, the rim structure attached to the external perimeter of the access region.

9. The multi-compartment pharmaceutical vial of claim 1, wherein the second end of each conduit includes an enlarged terminal region positioned adjacent to the access aperture.

10. The multi-compartment pharmaceutical vial of claim 1, further comprising a fastener including a top edge region, a side edge region, and a bottom edge region, each of the regions including an inner face configured to reversibly mate with an outer surface of the access region.

11. The multi-compartment pharmaceutical vial of claim 1, further comprising:

wherein the at least one cover includes at least one substantially planar and circular cover for the at least one conduit seal, the at least one cover including an upper surface and a lower surface;

a fastener including a top edge region including an inner surface configured to reversibly mate with the top surface of the cover, and a side edge region and a bottom edge region, each including an inner surface configured to reversibly mate with an outer surface of the access region;

a series of ratchet teeth attached to an outer edge of the at least one substantially planar and circular cover; and at least one pawl attached to the inner surface of the fastener, the pawl configured to reversibly mate with the series of ratchet teeth, wherein the pawl is positioned to engage with the series of ratchet teeth and restrict rotation of the cover when the fastener and the at least one substantially planar and circular cover are in place adjacent to the multi-compartment pharmaceutical vial.

12. The multi-compartment pharmaceutical vial of claim 1, further comprising:

wherein the at least one cover includes a plurality of overlapping planar structures, each including an upper surface and a lower surface, each planar structure including a distal edge; and a fastener including a top edge region including an inner surface configured to reversibly mate with the top surface of the cover, and a side edge region and a bottom edge region, each including an inner surface configured to reversibly mate with an outer surface of the access region;

at least one ratchet tooth attached to the distal edge of each of the plurality of overlapping planar structures; and at least one pawl attached to the inner surface of the fastener, the pawl configured to reversibly mate with each of the at least one ratchet tooth on each of the plurality of overlapping planar structures, wherein the pawl is positioned to engage with the each of the at least one ratchet tooth and restrict rotation of the cover when the fastener and the cover are in place adjacent to the multi-compartment pharmaceutical vial.

13. The multi-compartment pharmaceutical vial of claim 1, wherein the at least one conduit seal is fabricated with a light-polarizing material at a surface location of the at least one conduit seal opposing the end of the conduit.

14. The multi-compartment pharmaceutical vial of claim 1, wherein the at least one conduit seal is fabricated including material configured to visually indicate damage at a surface location of the at least one conduit seal opposing the end of the conduit.

15. The multi-compartment pharmaceutical vial of claim 1, further comprising a removable access tab including a first region positioned over one of the at least one conduit seal, and a second region configured to facilitate removal of the removable access tab.

16. A multi-compartment pharmaceutical vial comprising:

a multi-compartment pharmaceutical storage region, including a bottom wall, at least one outer wall, and at least one interior wall, the walls forming at least two pharmaceutical storage compartments, each of the at least two pharmaceutical storage compartments including an aperture at a position distal to the bottom wall;

an access region attached to the pharmaceutical storage region, the access region including a plurality of conduits with a first end and a second end, wherein the first end of each conduit is connected to one aperture in a pharmaceutical storage compartment, and wherein the second end of each conduit forms an access aperture positioned opposite to the bottom wall, the access region including an outer surface;

at least one conduit seal reversibly mated with at least one second end of one of the plurality of conduits, the at least one conduit seal substantially sealing the at least one second end of the one of the plurality of conduits, and the at least one conduit seal being configured to be pierced by a needle of a syringe to withdraw a material therein; and a cover with a surface reversibly mated with the outer surface of the access region and a surface of the at least one conduit seal, the cover being separate from and disposed over the at least one conduit seal and having at least one cover aperture therein, each of the at least one cover aperture being substantially aligned with the second end of a respective one of the plurality of conduits.

17. The multi-compartment pharmaceutical vial of claim 16, wherein the multi-compartment pharmaceutical storage region and the access region are integrally sealed to each other.

18. The multi-compartment pharmaceutical vial of claim 16, wherein the multi-compartment pharmaceutical storage region comprises:

four outer walls oriented as a first rectangle; and wherein the at least one interior wall includes a central wall positioned to divide the first rectangle into two second rectangles, and at least one spacing wall positioned to divide each of the second rectangles into two separate rectangles.

19. The multi-compartment pharmaceutical vial of claim 16, wherein the at least two pharmaceutical storage compartments comprise:

an even number of pharmaceutical storage compartments, arrayed as linear pairs.

20. The multi-compartment pharmaceutical vial of claim 16, wherein the multi-compartment pharmaceutical storage region comprises:

a plurality of pharmaceutical storage compartments, each pharmaceutical storage compartment formed with a substantially cylindrical interior surface within the multi-compartment pharmaceutical storage region.

21. The multi-compartment pharmaceutical vial of claim 16, wherein the outer diameter of the multi-compartment pharmaceutical storage region is greater than the outer diameter of the access region.

22. The multi-compartment pharmaceutical vial of claim 16, wherein the outer diameter of the access region is substantially circular.

23. The multi-compartment pharmaceutical vial of claim 16, wherein the access region comprises:

a flange at least partially circumscribing an external perimeter of the access region.

24. The multi-compartment pharmaceutical vial of claim 16, wherein the second end of each conduit includes an enlarged terminal region positioned adjacent to the access aperture.

25. The multi-compartment pharmaceutical vial of claim 16, wherein the at least one conduit seal comprises:

a light-polarizing material at a surface location of the at least one conduit seal adjacent to the second end of the conduit.

26. The multi-compartment pharmaceutical vial of claim 16, wherein the at least one conduit seal comprises:

a material configured to visually indicate physical damage to the at least one conduit seal.

27. The multi-compartment pharmaceutical vial of claim 16, further comprising:

a removable access tab including a first region positioned over one of the at least one conduit seal, and a second region configured to facilitate removal of the removable access tab.

28. The multi-compartment pharmaceutical vial of claim 16, further comprising:

a fastener including a top edge region including an inner surface configured to reversibly mate with the top surface of the cover, and a side edge region and a bottom edge region, each including an inner surface configured to reversibly mate with an outer surface of the access region;

a series of ratchet teeth attached to an outer edge of the cover; and at least one pawl attached to the inner surface of the fastener, the pawl configured to reversibly mate with the series of ratchet teeth, wherein the pawl is positioned to engage with the series of ratchet teeth and restrict rotation of the cover when the fastener and the cover are in place adjacent to the multi-compartment pharmaceutical vial.

29. A multi-compartment pharmaceutical vial comprising:

a multi-compartment pharmaceutical storage region, including a bottom wall, at least one outer wall, and at least one interior wall, the walls forming an even number of pharmaceutical storage compartments, each of the pharmaceutical storage compartments including a single aperture at a position distal to the bottom wall, and each of the pharmaceutical storage compartments positioned adjacent to the at least one outer wall;

an access region including an outer surface, the access region attached to the pharmaceutical storage region, the access region including a plurality of conduits with a first end and a second end, wherein the first end of each conduit is connected to the single aperture in a pharmaceutical storage compartment, and wherein the second end of each conduit forms an access aperture positioned opposite to the bottom wall;

at least one conduit seal reversibly mated with at least one second end of one of the plurality of conduits, the at least one conduit seal substantially sealing the at least one second end of the one of the plurality of conduits, and the at least one conduit seal being configured to be pierced by a needle of a syringe to withdraw a material therein; and a cover with a surface reversibly mated with outer surface of the access region and a surface of the at least one conduit seal, the cover being separate from and disposed over the at least one conduit seal and having at least one cover aperture therein, each of the at least one cover aperture being substantially aligned with the second end of a respective one of the plurality of conduits.

30. The multi-compartment pharmaceutical vial of claim 29, wherein the multi-compartment pharmaceutical storage region and the access region are integrally sealed to each other.

31. The multi-compartment pharmaceutical vial of claim 29, wherein the even number of pharmaceutical storage compartments are arrayed as linear pairs.

32. The multi-compartment pharmaceutical vial of claim 29, wherein the even number of pharmaceutical storage compartments comprise:

a substantially cylindrical interior surface of each of the even number of pharmaceutical storage compartments within the multi-compartment pharmaceutical storage region.

33. The multi-compartment pharmaceutical vial of claim 29, wherein the outer diameter of the multi-compartment pharmaceutical storage region is greater than the outer diameter of the access region.

34. The multi-compartment pharmaceutical vial of claim 29, wherein the outer diameter of the access region is a substantially circular structure.

35. The multi-compartment pharmaceutical vial of claim 29, wherein the access region comprises:

a rim structure at least partially circumscribing an external perimeter of the access region, the rim structure attached to the external perimeter of the access region.

36. The multi-compartment pharmaceutical vial of claim 29, wherein the access region comprises:

a second end of each conduit including an enlarged terminal region positioned adjacent to the access aperture.

37. The multi-compartment pharmaceutical vial of claim 29, wherein each of the plurality of conduits are substantially cylindrical in shape.

38. The multi-compartment pharmaceutical vial of claim 29, wherein the at least one conduit seal comprises:

a light-polarizing material at a surface location of the at least one conduit seal adjacent to the second end of the conduit.

39. The multi-compartment pharmaceutical vial of claim 29, wherein the at least one conduit seal comprises:

a material configured to visually indicate physical damage to the at least one conduit seal.

40. The multi-compartment pharmaceutical vial of claim 29, further comprising:

a removable access tab including a first region positioned over one of the at least one conduit seal, and a second region configured to facilitate removal of the removable access tab.

41. The multi-compartment pharmaceutical vial of claim 29, further comprising:

a fastener including a top edge region including an inner surface configured to reversibly mate with the top surface of the cover, and a side edge region and a bottom edge region, each including an inner surface configured to reversibly mate with an outer surface of the access region;

a series of ratchet teeth attached to an outer edge of the cover; and at least one pawl attached to the inner surface of the fastener, the pawl configured to reversibly mate with the series of ratchet teeth, wherein the pawl is positioned to engage with the series of ratchet teeth and restrict rotation of the cover when the fastener and the cover are in place adjacent to the multi-compartment pharmaceutical vial.

* * * * *